US011013296B2

(12) United States Patent
Fenato et al.

(10) Patent No.: US 11,013,296 B2
(45) Date of Patent: May 25, 2021

(54) MODULAR ARTICLE OF FOOTWEAR AND METHOD OF MANUFACTURING CUSTOMIZED ARTICLE OF FOOTWEAR

(71) Applicant: NIKE, Inc., Beaverton, OR (US)

(72) Inventors: Piero Fenato, Beaverton, OR (US); Elizabeth Langvin, Sherwood, OR (US); Randall S. Wolfe, Beaverton, OR (US); Krissy Yetman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 67 days.

(21) Appl. No.: 15/967,707

(22) Filed: May 1, 2018

(65) Prior Publication Data

US 2018/0317608 A1 Nov. 8, 2018

Related U.S. Application Data

(60) Provisional application No. 62/503,013, filed on May 8, 2017.

(51) Int. Cl.
*A43B 23/02* (2006.01)
*A43B 3/00* (2006.01)
(Continued)

(52) U.S. Cl.
CPC ..... *A43B 23/0295* (2013.01); *A43B 3/0078* (2013.01); *A43B 3/244* (2013.01);
(Continued)

(58) Field of Classification Search
CPC .... A43B 9/16; A43B 9/10; A43B 9/18; A43B 23/0295; A43B 3/0078; A43B 3/244;
(Continued)

(56) References Cited

U.S. PATENT DOCUMENTS 4,377,042 A * 3/1983 Bauer ..... A43B 13/36 36/101
4,887,369 A * 12/1989 Bailey ..... A43B 3/24 36/101

(Continued)

FOREIGN PATENT DOCUMENTS

CN 201238660 Y 5/2009
CN 204580042 U 8/2015

(Continued)

*Primary Examiner* — Sharon M Prange
*Assistant Examiner* — Erick I Lopez
(74) *Attorney, Agent, or Firm* — Quinn IP Law

(57) ABSTRACT

A modular article of footwear comprises a sole structure having a foot-facing surface, a ground-engaging surface, and a peripheral side surface extending between the foot-facing surface and the ground-engaging surface. The peripheral side surface has at least one recess. The modular article of footwear includes an upper component, and a flange secured to the upper component and projecting therefrom. An inner surface of the flange fits against and is securable to the peripheral side surface of the sole structure with the flange in the at least one recess, and the upper component at least partially defining a foot-receiving cavity over the foot-facing surface. A method of manufacturing a customized article of footwear comprises receiving a request for an upper with a specified characteristic, and assembling the modular article of footwear having an upper in accordance with the request.

18 Claims, 16 Drawing Sheets

(51) Int. Cl.

| | |
|---|---|
| ***A43B 9/12*** | (2006.01) |
| ***A43B 13/32*** | (2006.01) |
| ***A43B 9/02*** | (2006.01) |
| ***A43B 9/00*** | (2006.01) |
| ***A43B 13/28*** | (2006.01) |
| ***A43B 3/24*** | (2006.01) |

(52) U.S. Cl.
CPC ..... *A43B 9/00* (2013.01); *A43B 9/02* (2013.01); *A43B 9/12* (2013.01); *A43B 13/28* (2013.01); *A43B 13/32* (2013.01)

(58) Field of Classification Search
CPC .... A43B 9/00; A43B 9/02; A43B 9/12; A43B 13/28; A43B 13/32
See application file for complete search history.

(56) References Cited

U.S. PATENT DOCUMENTS

| | | | | |
|---|---|---|---|---|
| 5,065,531 | A * | 11/1991 | Prestridge | A43C 1/00 36/100 |
| 5,083,385 | A * | 1/1992 | Halford | A43B 13/36 36/100 |
| 5,933,983 | A | 8/1999 | Jeon | |
| 6,430,846 | B1 | 8/2002 | Lin | |
| 6,895,697 | B2 | 5/2005 | Yang | |
| 6,910,288 | B2 | 6/2005 | Dua | |
| 6,931,766 | B2 | 8/2005 | Greene | |
| 7,810,257 | B2 | 10/2010 | Candrian et al. | |
| 7,945,343 | B2 | 5/2011 | Jones et al. | |
| 7,987,617 | B2 | 8/2011 | Kohatsu et al. | |
| 8,307,570 | B2 | 11/2012 | Delgatty | |
| 8,591,784 | B1 | 11/2013 | Chung | |
| 8,850,719 | B2 | 10/2014 | Hawkinson et al. | |
| 9,044,060 | B2 | 6/2015 | Delaney | |
| 9,402,445 | B2 * | 8/2016 | Miller | B41J 3/4073 |
| 2007/0094897 | A1 * | 5/2007 | Nakatsu | A43D 999/00 36/100 |
| 2007/0227039 | A1 * | 10/2007 | Chaney | A43B 5/08 36/15 |
| 2007/0240336 | A1 | 10/2007 | Richardson | |
| 2008/0098623 | A1 * | 5/2008 | Komitau | A43B 3/244 36/101 |
| 2010/0275393 | A1 | 11/2010 | Jou et al. | |
| 2011/0225845 | A1 | 9/2011 | Dean et al. | |
| 2011/0302803 | A1 | 12/2011 | Kim | |
| 2012/0260530 | A1 * | 10/2012 | Policastro | A43B 1/0027 36/101 |
| 2013/0036628 | A1 * | 2/2013 | Hussey | A43B 3/0078 36/87 |
| 2013/0067639 | A1 | 3/2013 | Dua et al. | |
| 2014/0237738 | A1 | 8/2014 | Johnson et al. | |
| 2015/0040434 | A1 * | 2/2015 | Perkins | A43B 3/24 36/101 |
| 2016/0242493 | A1 | 8/2016 | Stillwagon | |
| 2016/0242505 | A1 | 8/2016 | Waatti | |
| 2016/0318243 | A1 | 11/2016 | Dua et al. | |
| 2019/0254381 | A1 * | 8/2019 | Hopkins | A43B 3/248 |

FOREIGN PATENT DOCUMENTS

| | | | |
|---|---|---|---|
| EP | 2218347 | A1 | 8/2010 |
| FR | 2965456 | A1 | 4/2012 |
| FR | 3007255 | A1 | 12/2014 |
| WO | 9939600 | A1 | 8/1999 |
| WO | 2014198257 | A1 | 12/2014 |

* cited by examiner

MODULAR ARTICLE OF FOOTWEAR AND METHOD OF MANUFACTURING CUSTOMIZED ARTICLE OF FOOTWEAR

CROSS-REFERENCE TO RELATED APPLICATION

This application claims the benefit of priority to U.S. Provisional Application No. 62/503,013, filed May 8, 2017, which is hereby incorporated by reference in its entirety.

TECHNICAL FIELD

The present teachings generally include a modular article of footwear and a method of customizing an article of footwear.

BACKGROUND

The manufacturing of footwear is usually done in a factory, with runs of large quantities of identical footwear. For example, uppers are secured to sole structures in factories by stitching, with adhesives, or by thermal processes such as thermal bonding. If a manufacturer offers customers the ability to request customized footwear, the individual custom orders must be tracked at the factory. This process can be time consuming in comparison to the manufacturing of stock (non-customized) footwear. Additionally, the time from receipt of the order to customer receipt of the customized footwear may be weeks longer than if a non-customized pair of footwear is ordered.

DESCRIPTION

Figure 1:
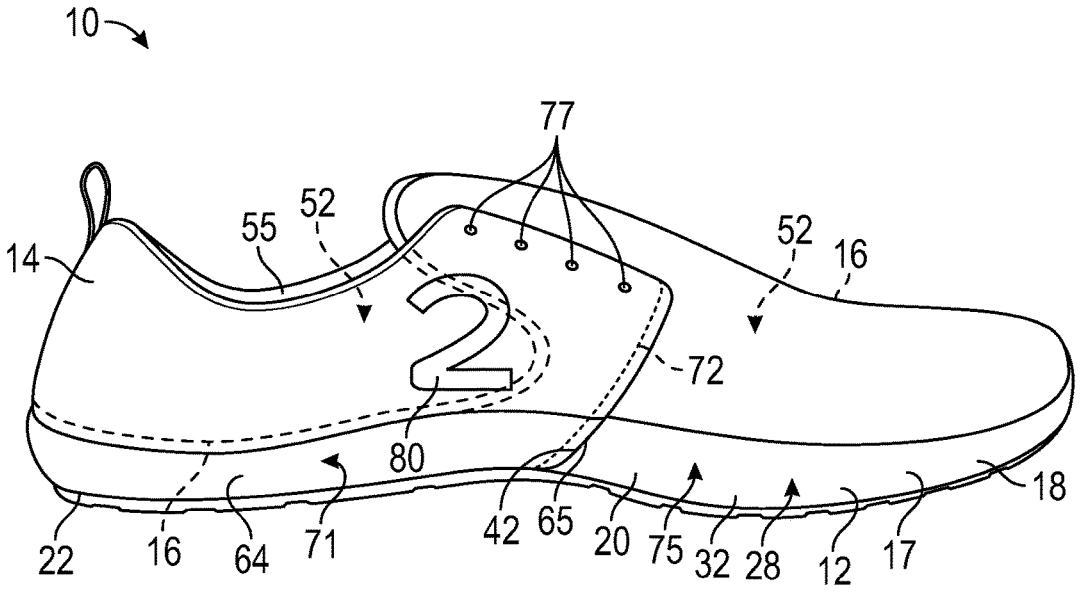
FIG. 1 is a schematic illustration in perspective side view of an embodiment of a modular article of footwear.

A modular article of footwear and a method of manufacturing a customized article of footwear are disclosed herein. By configuring the footwear as various modules, the ease and speed of customization as well as the number of customization options are maximized, as modules can be manufactured prior to customization in a state ready for final assembly of the article of footwear. The modular article of footwear includes a sole structure that has a foot-facing surface, a ground-engaging surface, and a peripheral side surface extending between the foot-facing surface and the ground-engaging surface. The peripheral side surface has at least one recess. A module includes an upper component and a flange secured to the upper component and projecting therefrom. As used in the description and the accompanying claims, a "flange" includes a "rand," or a portion of a "rand," as will be understood by those skilled in the relevant arts. An inner surface of the flange fits against and is securable to the peripheral side surface of the sole structure with the flange in the at least one recess. When the flange is secured to the sole structure, the upper component at least partially defines a foot-receiving cavity over the foot-facing surface. As further described herein, the article of footwear may include multiple modules, such as a module that is a sole structure with no upper components, a module that includes a sole structure and one or more upper components secured to the sole structure, a single module that includes an upper component that is a single, unitary, one-piece upper, and also includes a flange secured thereto, or multiple modules each including an upper component and a single flange, and all of which are secured to a module that includes the sole structure. In some embodiments, the upper component is a first material, and the flange is a second material. The second material may be the same material as the peripheral side surface of the sole structure in some embodiments. For example, the flange may be a polymer foam.

As discussed herein, the article of footwear can be customized by selection of the module and/or by secondary processes applied to the module, such as by printing or otherwise applying a graphical image on the upper component of the module prior to securing the module to the sole structure. The modules can be pre-made, leaving only securement to the sole structure and any secondary customization to be carried out after receiving a customization request for a customer. The pre-made modules are configured to be securable to the sole structure with manufacturing methods that are relatively fast and require a minimal amount of tooling and machinery. In some cases, the customization and assembly can occur at a retail outlet while a customer waits.

In an aspect of the disclosure, the peripheral side surface of the sole structure has at least one first locating feature in the recess. The flange of the module has at least one second locating feature at the inner surface. The at least one first locating feature interfits with the at least one second locating feature. The locating features are configured in shape, location, and number to ensure that an assembler can easily, accurately, and quickly fit the flange to the sole structure. The at least one second locating feature numbers the same as the at least one first locating feature, and is complementary to the first locating feature. Stated differently, the first locating feature(s) and the second locating feature(s) are cooperatively configured with complementary shapes to interfit.

For example, the at least one first locating feature may be one of a protrusion of, or a recess in, the peripheral side surface of the sole structure. In one such embodiment, the at least one first locating feature is one of a ridge and a slot, the at least one second locating feature is the other of the ridge and the slot, and the ridge fits within the slot. In an embodiment, the slot extends in the peripheral side surface along a rear periphery of the sole structure from a medial side of the sole structure to a lateral side of the sole structure, the second locating feature is the ridge, and the ridge protrudes at the inner surface of the flange.

In an aspect of the disclosure, the sole structure and the flange may mechanically secure to one another, so that the module can be easily secured to the sole structure during the customization process. For example, the sole structure has one of a male connector and a female connector, and the flange has the other of the male connector and the female connector. The locating features may serve as the mechanical connectors, or the mechanical connectors may be additional features, such as the ridge and slot discussed herein.

Instead of or in addition to mechanical connectors, an adhesive may be disposed on either or both of the inner surface of the flange and the peripheral side surface of the sole structure to secure the flange to the sole structure. In some embodiments, the adhesive may be a hot melt adhesive, in which case the adhesive has a lower melting temperature than the material of the flange. Still further, instead of or in addition to adhesive, a thermal process may be used to secure the flange to the sole structure. For example, the upper component may include a first material, and the flange may include a second material that thermally bonds (i.e., fuses) to the sole structure under sufficient heating. For example, both the flange and the sole structure may be a polymer foam, such as a thermoplastic polymer foam or a thermoset polymer foam.

In various embodiments, the sole structure may not have any upper components secured thereto prior to the start of the customization process. Alternatively, the sole structure itself may be included in a module with an upper component that is secured to the sole structure prior to customization, in which case the sole structure with upper component secured thereto serves as a base module, and one or more other modules to be secured thereto can be selected according to a customization request. In either case, more than one module may be secured to the sole structure during the customization process, such as but not limited to two, three, four, or five modules, each module including a flange and an upper component. For example, in one embodiment, a module may include an upper component and a flange securable to the sole structure where the upper component serves as a heel region of an upper. In the same or a different embodiment, a module may include an upper component and a flange securable to the sole structure where the upper component serves as a forefoot region of the upper.

In some embodiments, the at least one recess is a single recess. For example, the sole structure and the upper component may each include a forefoot region, a midfoot region, and a heel region, the at least one recess may be a single recess extending around the peripheral side surface throughout the forefoot region, the midfoot region, and the heel region of the sole structure, and the flange may be a single flange extending around the forefoot region, the midfoot region, and the heel region of the upper component. The flange may be continuous, or in some embodiments, the upper component may have a split that helps enable the upper component to achieve a relatively flat state desirable for some customization processes. The upper component can then be seamed together at the split after customization to help achieve a three-dimensional shape that defines a foot-receiving cavity. For example, the upper component may have a split heel region, and the flange may have a first end at a medial side of the split heel region and a second end at a lateral side of the split heel region.

In an embodiment, more than one module is secured to the sole structure. For example, the upper component is a first upper component and the flange is a first flange. The article of footwear further comprises a second upper component, and a second flange secured to the second upper component and projecting therefrom. An inner surface of the second flange and the peripheral side surface of the sole structure are configured to fit against one another with the second flange in the at least one recess, the second upper component further defining the foot-receiving cavity, and the second flange secured to the peripheral side surface. In such an embodiment, when the second flange is secured to the peripheral side surface of the sole structure in the at least one recess, the second upper component is adjacent to the first upper component, and the article of footwear may have stitching that secures the second upper component to the first upper component.

In some embodiments, the at least one recess includes a first recess and a second recess separated from the first recess by a non-recessed portion of the peripheral side surface of the sole structure. In such an embodiment, the inner surface of the first flange fits against and is securable to the peripheral side surface of the sole structure with the first flange in the first recess, and the inner surface of the second flange fits against and is securable to the peripheral side surface of the sole structure with the second flange in the second recess. The first flange is separated from the second flange by the non-recessed portion of the peripheral side surface.

In another embodiment, the sole structure is included in a first module having an additional upper component secured to the sole structure and partially defining the foot-receiving cavity over the foot-facing surface. The first module is manufactured prior to the customization process. The additional upper component may be spaced apart from the at least one recess to which a second module (including the upper component and the flange) secure. In such an embodiment, when the flange of the second module is secured to the peripheral side surface of the sole structure in the recess, the additional upper component is adjacent to the upper component, and the article of footwear may include stitching that secures the second upper component to the first upper component.

In an embodiment, an outer surface of the flange may be flush with an adjacent portion of the peripheral side surface when the inner surface of the flange and the peripheral side surface of the sole structure are fit against and secured to one another with the flange in the recess.

Still further, the peripheral side surface of the sole structure may have a curvature at the recess, such as but not limited to a curvature at the rear of or at the front of the sole structure from a medial side to a lateral side of the sole structure. The upper component and the flange secured thereto may be sufficiently flexible to adopt a first state when the flange is disjoined from the sole structure, and a second state when the flange is secured to the sole structure in the recess, so that the inner surface of the flange has the curvature of the peripheral side surface in the second state.

The module with the flange and the upper component may be relatively flat in the first state in comparison to the second state. This may be advantageous for some customization processes that are more optimally performed with the module relatively flat. For example, various printing techniques that may be used for customization can be performed with the module in the first state. Some printing apparatuses more accurately print when the printer head may be maintained relatively close to the surface to be printed. In one example embodiment, a predetermined region of a surface of the upper component has a maximum variance in elevation of less than or equal to 10 millimeters in the first state. Such a variance in elevation may enable a customized graphical image to be applied on the upper component with an ink jet printer having a relatively stationary printer head that prints most optimally when the surface to be printed is disposed within a 10 millimeter range from the ink nozzle. Accordingly, in the example embodiment, the predetermined region of the surface of the upper component has a graphical image thereon and the graphical image is comprised of ink.

Additionally, the sole structure may be customized in accordance with a request for a specified stiffness or stability characteristic. For example, the sole structure may have a cavity at the peripheral side surface. The modular article of footwear may include an insert shaped and sized to fit within the cavity. The insert may have a different compressive stiffness than the sole structure. Accordingly, when the insert is placed in the cavity, the sole structure with the insert therein provides the specified stiffness or stability characteristic. References herein to a "stiffness" of a component refer to the compressive stiffness of the component.

Within the scope of the present teachings, an article of footwear comprises an upper component, and a flange secured to the upper component and projecting therefrom. The upper component is a first material and the flange is a polymer foam. For example, the flange may be a thermoplastic polymer foam material or a thermoset polymer foam material. The material of the flange may be the same as the material of a midsole of a sole structure to which it is to be secured. In some embodiments, the upper component includes a forefoot region, a midfoot region, and a heel region, and the flange extends along the forefoot region, the midfoot region, and the heel region of the upper component. In some embodiments, the upper component has a split heel region, and the flange has a first end at a medial side of the split heel region and a second end at a lateral side of the split heel region. In other embodiments, the upper component comprises only a heel region, only a midfoot region, or only a forefoot region, or not more than two selected from among a heel region, a midfoot region, and a forefoot region.

A method of manufacturing a customized article of footwear comprises receiving a request for an upper with a specified characteristic, and assembling a modular article of footwear in accordance with the request by securing a module to a sole structure. The sole structure has a foot-facing surface, a ground-engaging surface, and a peripheral side surface extending between the foot-facing surface and the ground-engaging surface, the peripheral side surface has at least one recess. The module includes an upper component having the specified characteristic, and a flange secured to the upper component and projecting therefrom. Securing the module to the sole structure comprises fitting an inner surface of the flange against the peripheral side surface of the sole structure with the flange in the at least one recess and with the upper component partially defining a foot-receiving cavity over the foot-facing surface, and securing the inner surface of the flange to the peripheral side surface of the sole structure.

By way of non-limiting example, within the scope of the disclosure, the specified characteristic requested may be one of an aesthetic characteristic, a performance characteristic, a dimensional characteristic, a material, a physical property, or a footwear style. Examples of an aesthetic characteristic include a graphical image, such as a number, a picture, a name, or other text, or simply a choice of color of the upper component or a portion thereof.

Examples of performance characteristics may include upper components categorized by the manufacturer as stiff, flexible, supportive, breathable, for training, for leisure etc., and may be related to specified characteristics which are more specific physical properties, such as a stiffness within a range of numerical stiffnesses, elasticity within a range of elasticities, etc.

Examples of dimensional characteristics may include thickness of the upper, which may be determined by the amount of padding that can be added to satisfy a specified request. For example, the thickness of the upper can be selected to enable the same size sole structure to be used for different orders within a half-size of one another. A module with a relatively thick upper can be used if the customer requests footwear of a first size, while a relatively thin upper can be used if the customer requests footwear of a second size larger than the first size, as the flange that interfaces with the sole structure will be identical with either module. This enables a smaller inventory of sole structures to be kept on hand by a seller and/or manufacturer. Additionally, the dimensions of the upper can be tailored, such as by adding padding, to satisfy a specified request in order to be optimal for a customer with a foot abnormality. Examples of materials may include leather, textiles, polymers, cottons, composites, etc., with different weaves, braids or knits. Examples of footwear styles may include high top, low top, mule, etc.

In an embodiment, the upper component has a split heel region, the flange has a first end at a medial side of the split heel region and a second end at a lateral side of the split heel region, and the specified characteristic is a graphical image. In such an embodiment, the method further comprises printing the graphical image on a surface of the upper component prior to the securing the inner surface of the flange to the peripheral side surface of the sole structure. After said printing and prior to fitting the inner surface of the flange against the peripheral side surface and securing the inner surface of the flange to the peripheral side surface, the method includes securing the lateral side of the split heel region to the medial side of the split heel region.

In another embodiment, the at least one recess includes a first recess and a second recess separated from the first recess by a non-recessed portion of the peripheral side surface of the sole structure. In such an embodiment, fitting the inner surface of the flange against the peripheral side surface of the sole structure is with the flange in the first recess, and fitting an inner surface of the additional flange against the peripheral side surface of the sole structure is with the additional flange in the second recess and with the flange separated from the additional flange by the non-recessed portion of the peripheral side surface.

Within the scope of the disclosure, fitting the inner surface of the flange to the peripheral side surface of the sole structure may include interfitting at least one first locating feature provided on the sole structure with at least one second locating feature provided on the flange. For example, the peripheral side surface of the sole structure may have at least one first locating feature in the at least one recess, and the flange may have at least one second locating feature at the inner surface.

In an example embodiment in which the at least one first locating feature includes a slot extending along the peripheral side surface from a medial side of the sole structure to a lateral side of the sole structure, and the at least one second locating feature includes a ridge protruding at the inner surface of the flange, the method may further comprise aligning the ridge with the slot prior to the interfitting the slot with the ridge.

In an example embodiment in which the peripheral side surface has at least one first locating feature in the at least one recess, and the flange has at least one second locating feature at the inner surface, fitting the inner surface of the flange to the peripheral side surface of the sole structure may include interfitting the at least one first locating feature with the at least one second locating feature.

In an example embodiment in which the at least one first locating feature includes a slot extending along the peripheral side surface from a medial side of the sole structure to a lateral side of the sole structure, and the at least one second locating feature includes a ridge protruding at the inner surface of the flange, the method may further comprise aligning the ridge with the slot prior to the interfitting the slot with the ridge.

Under the method, the manufacturer or retailer will have on hand an inventory with various sets of modules in order to be ready to satisfy any of a number of different possible customization requests. The method may further comprise selecting the module from an inventory of modules, wherein the inventory includes at least a first set of modules and a second set of modules, and wherein each of the modules of the first set has an upper component that has the specified characteristic. For example, each of the modules of the second set may have an upper component without the specified characteristic. Each of the modules of the second set may have an upper component with a characteristic different than the specified characteristic. In either case, carrying out the first set is identified as satisfying the customer's request.

In an embodiment in which the specified characteristic is a graphical image, the method may further comprise printing the graphical image on a surface of the upper component prior to the securing the inner surface of the flange to the peripheral side surface of the sole structure. In an embodiment, the printing is ink-jet printing, and the method further comprises, prior to printing the graphical image on the surface of the upper component, placing the module in a first state in which a predetermined region of a surface of the upper component has a maximum variance in elevation of less than or equal to 10 millimeters in the first state. Printing the graphical image on the surface of the upper component is done with the module in the first state. In other embodiments, the graphical image may be provided by processes other than ink-jet printing, such as but not limited to three-dimensional printing, painting, stamping, heat transfer, etc.

In an embodiment, securing the inner surface of the flange to the peripheral side surface of the sole structure includes adhering the inner surface of the flange to the peripheral side surface of the sole structure. In the same or a different embodiment, securing the inner surface of the flange to the peripheral side surface of the sole structure includes thermally bonding the inner surface of the flange to the peripheral side surface of the sole structure.

The method also enables customization requests that are specific to only one article of footwear of a pair of footwear, such as a right shoe or a left shoe. For example, in an embodiment, the article of footwear is a first article of footwear of a pair of footwear that includes the first article of footwear and a second article of footwear. The specified characteristic is a first specified characteristic. One of the first article of footwear and the second article of footwear has a right foot orientation and the other of the first article of footwear and the second article of footwear has a left foot orientation. The method further comprises receiving a request for the second article of footwear having a second upper with a second specified characteristic different than the first specified characteristic. The method further comprises assembling the second article of footwear in accordance with the request for the second article of footwear by securing an inner surface of an additional flange of an additional module to a sole structure of the second article of footwear. Similar to the first article of footwear, the sole structure of the second article of footwear has a foot-facing surface, a ground-engaging surface, and a peripheral side surface extending between the foot-facing surface and the ground-engaging surface. The peripheral side surface of the second article of footwear has at least one recess. The additional module has an additional upper component secured to the additional flange of the additional module, and the additional upper component has the second specified characteristic.

In an embodiment in which the sole structure is included in a first module having an additional upper component secured to the sole structure and partially defining the foot-receiving cavity over the foot-facing surface, with the additional upper component spaced apart from the at least one recess, and where the upper component and the flange are a second module, the method may further comprise stitching the upper component to the additional upper component after securing the flange of the second module to the peripheral side surface of the sole structure.

In an embodiment in which the upper component is a first upper component, the flange is a first flange, the specified characteristic is a first specified characteristic, and the request for the upper further includes a second specified characteristic, assembling the modular article of footwear in accordance with the request may further include securing a second module to the sole structure. The second module includes an additional upper component, and an additional flange secured to the additional upper component and projecting therefrom. Securing the second module to the sole structure may comprise fitting an inner surface of the additional flange against the peripheral side surface of the sole structure with the additional flange in the at least one recess and with the additional upper component further defining the foot-receiving cavity.

Additionally, the method may include customizing the sole structure in response to a request for a specified stiffness or stability characteristic. For example, the method may include receiving a request for a sole structure with a specified stiffness or stability characteristic, and inserting an insert into a cavity in the peripheral side surface of the sole structure. The insert has a compressive stiffness different than the sole structure, and the sole structure with the insert therein provides the specified stiffness or stability characteristic.

The above features and advantages and other features and advantages of the present teachings are readily apparent from the following detailed description of the modes for carrying out the present teachings when taken in connection with the accompanying drawings.

Referring to the drawings, where like reference numbers refer to like components, FIG. 1 shows a customized modular article of footwear 10 in a fully-manufactured state. The article of footwear 10 includes a sole structure 12 and a modular upper 14, 16 including a first upper component 14 and additional upper component 16. In the embodiment shown, the sole structure 12 includes a full-length unitary midsole 17 having a forefoot region 18, a midfoot region 20, and a heel region 22. The forefoot region 18, midfoot region 20, and heel region 22 also correspond with and can be used to refer to a forefoot region, a midfoot region, and a heel region, respectively, of the article of footwear 10. The sole structure 12 also includes an insole 23, best shown in FIG. 2. A strobel 21 may be secured to a lower periphery of the upper component 16. The insole 23 is a drop-in insole that rests on the midsole 17 or on a strobel 21 (if a strobel is provided), but is not secured to the strobel 21 or to the midsole 17 so that it is removable. In other embodiments, the insole 23 can be secured to the strobel 21 or to the midsole 17 by adhesive or otherwise.

Figure 2:
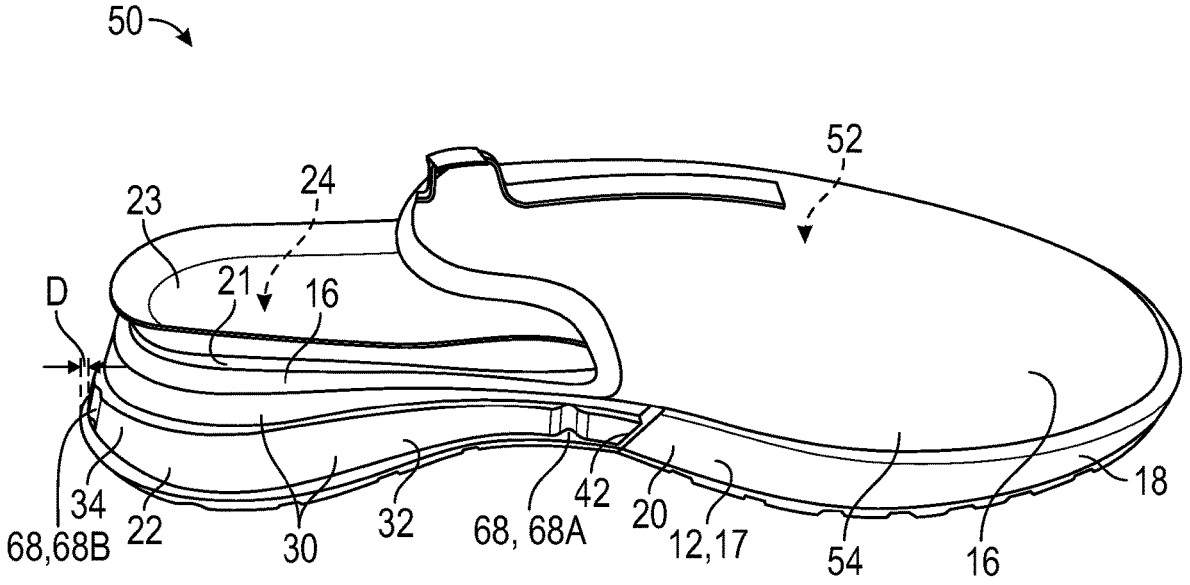
FIG. 2 is a schematic illustration in perspective side view of a medial side of a first module of the article of footwear of FIG. 1.
Figure 6:
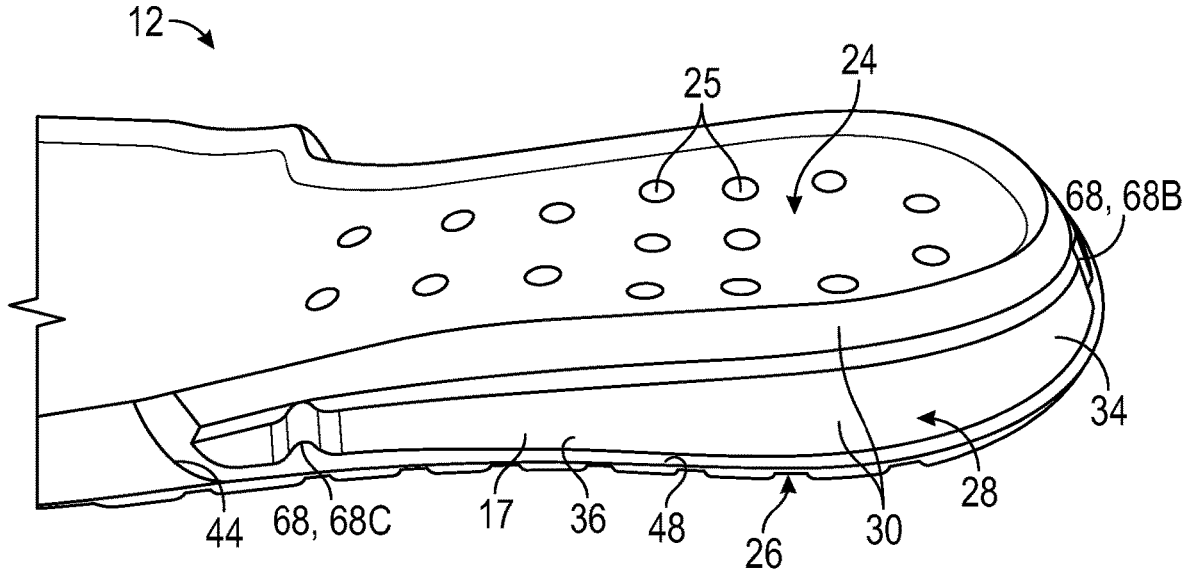
FIG. 6 is a schematic illustration in fragmentary perspective view of a sole structure of the first module of FIG. 2.

As best shown in FIG. 6, the sole structure 12 has a foot-facing surface 24, a ground-engaging surface 26, and a peripheral side surface 28 extending between the foot-facing surface 24 and the ground-engaging surface 26. Multiple recesses 25 are shown in the foot-facing surface 24 to increase compliance of the sole structure 12. The peripheral side surface 28 in this embodiment is a single, continuous recess 30 that extends along the medial side 32 of the sole structure 12, as shown in FIG. 2, around the rear periphery 34, and along a lateral side 36 of the sole structure 12. Accordingly, the recess 30 has a medial end 42, a lateral end 44, and a lower periphery 46 bounded by a lip 48 of the midsole 17. The articles of footwear herein are depicted as leisure shoes or athletic shoes, but the present teachings also include an article of footwear that is a dress shoe, a work shoe, a sandal, a slipper, a boot, or any other category of footwear.

The sole structure 12 is included in a first module 50 shown in FIG. 2. The first module 50 includes the upper component 16 secured to the sole structure 12 and partially defining a foot receiving cavity 52 over the foot-facing surface 24. The upper component 16 is secured to the sole structure 12 along a lower periphery 54 at the forefoot region 18, at the midfoot region 20, and at the heel region 22, and has a mule shape.

Figure 4:
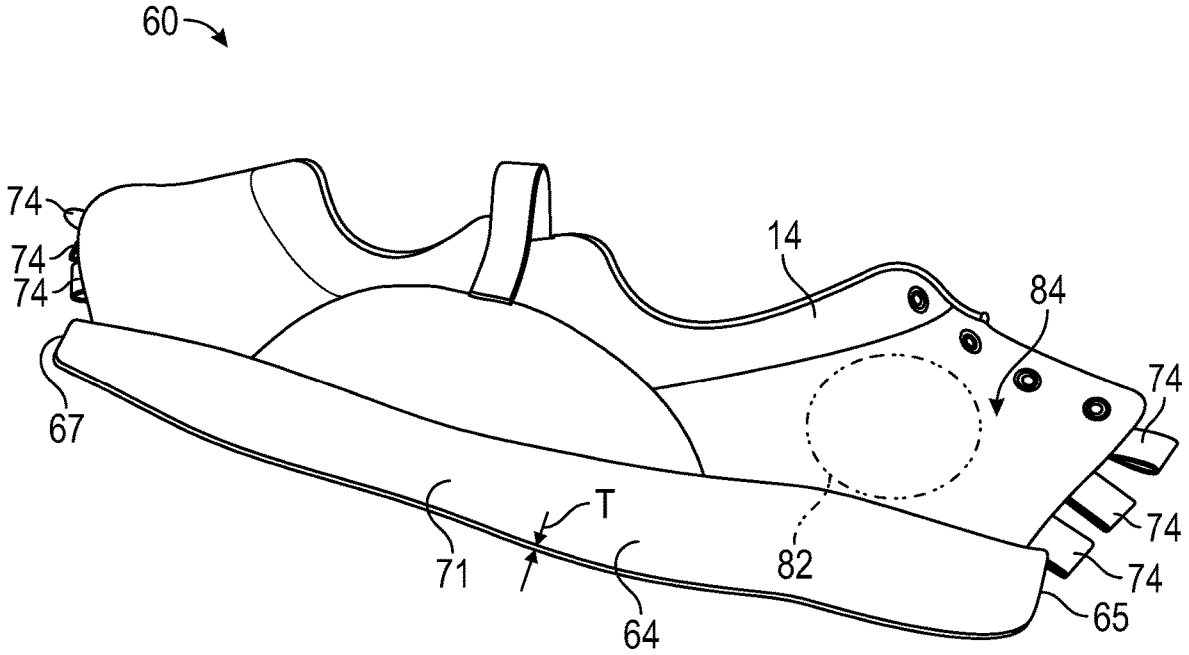
FIG. 4 is a schematic illustration in perspective view of an outer side of a second module of the article of footwear of FIG. 1, including a flange and an upper component.
Figure 5:
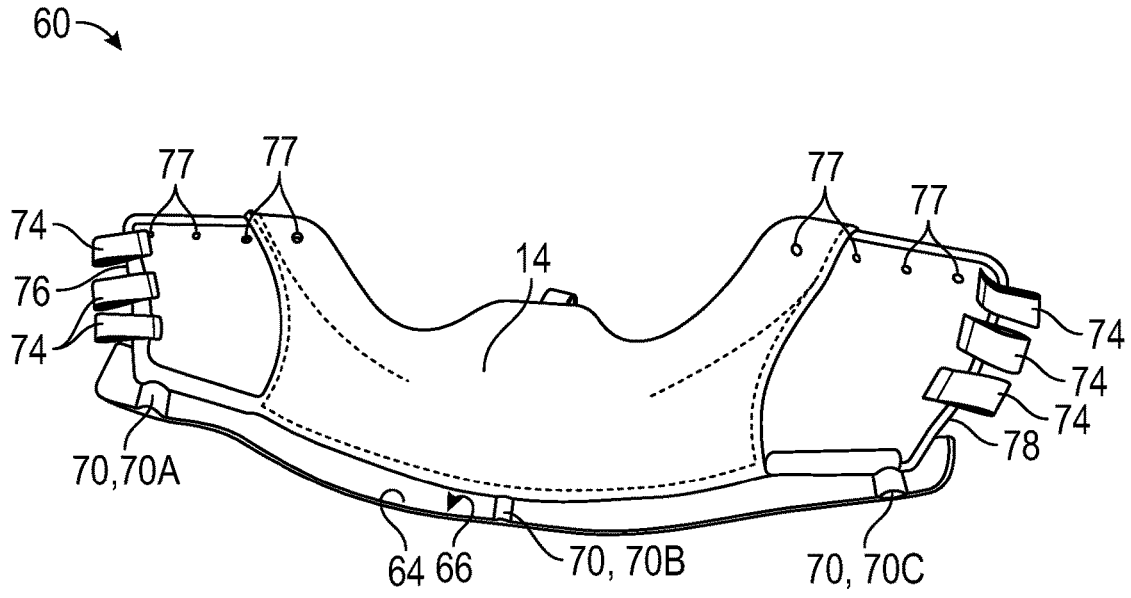
FIG. 5 is a schematic illustration in perspective view of an inner side of a second module of FIG. 4.

The article of footwear 10 also includes a second module 60 best shown in FIGS. 4 and 5. The second module 60 includes the upper component 14 and a flange 64 secured to the upper component 14 and projecting therefrom. The upper component 14 may be stitched, thermally bonded, adhered, or otherwise secured to the flange 64. The second module 60 is shown in a pre-customization state in FIGS. 4 and 5 in which it is discrete and separate from the first module 50. More specifically, the second module 60 is left unsecured from the first module 50 until a customization request is made, as the customization request may result in selection of the module 60 and/or additional processing of the module 60, referred to as one or more secondary processes. In addition to or even if no secondary processes are to be carried out to meet the customization request, this also enables the option of selecting a specific second module 60 from an inventory of available second modules, where the selected second module has a different characteristic than some of the other second modules in the inventory, such as a specific aesthetic characteristic, a specific performance characteristic, a specific dimensional characteristic, a specific material, a specific physical property, and/or a specific footwear style.

A second module 60 is configured to be secured to the first module 50 in a relatively quick manner without requiring extensive machinery so that, once a specific characteristic is requested, the customized article of footwear can be completed and provided relatively quickly. Accordingly, the first module 50 and the second module 60 could be secured to one another at a manufacturing facility or at a retail location following a customization request by a customer. More specifically, an inner surface 66 of the flange 64 (see FIG. 5) fits against and is securable to the peripheral side surface 28 of the sole structure 12 (see FIG. 6) with the flange 64 in the at least one recess 30. When the flange 64 is secured to the sole structure 12, the upper component 14 further defines the foot-receiving cavity 52 over the foot-facing surface 24. In other words, the upper component 16 defines a forefoot and midfoot region of the foot receiving cavity 52 and the upper component 14 defines a heel region of the foot receiving cavity 52 and provides an ankle opening 55.

In order to aid in quick and accurate assembly, the peripheral side surface 28 of the sole structure 12 has at least one first locating feature 68 in the recess 30. In the embodiment of FIGS. 5 and 6, there are three of the first locating features 68 in the recess 30, referred to as locating features 68A, 68B, and 68C (see FIGS. 2 and 3). First locating feature 68A is on the medial side 32 of the midsole 17 in the recess 30 near the medial end 42. First locating feature 68B is at a center of the rear periphery 34 of the midsole 17 in the recess 30. First locating feature 68C is on the lateral side 36 of the midsole 17 in the recess 30 near the lateral end 44. There may be additional first locating features 68 in the recess 30, or only one of the first locating features 68 may be provided. However, by providing a first locating feature 68 on each of the medial side, on the lateral side, and at the rear periphery, easy and accurate assembly of the second module 60 to the first module 50 is maximized.

The flange 64 of the second module 60 has at least one second locating feature 70 at the inner surface 66. The first locating feature(s) 68 interfits with the second locating feature(s) 70 when the first locating feature(s) 68 is aligned with the second locating feature(s) 70, and the inner surface 66 of the flange 64 is fit to the peripheral side surface 28 of the sole structure 12. In the embodiment of FIGS. 5 and 6, there are three of the second locating features 70 on the inner surface 66 of the flange 64, referred to as locating features 70A, 70B, and 70C. Second locating feature 70A interfits with first locating feature 68A, second locating feature 70B interfits with first locating feature 68B, and second locating feature 70C interfits with first locating feature 68C. There may be additional second locating features 70 on the inner surface 66, or only one of the second locating features 70 may be provided. Accordingly, the number of second locating features 70 is the same as the number of first locating features 68, each first locating feature 68 interfitting with a corresponding second locating feature 70.

The locating features 68, 70 are configured in shape, location, and number to ensure an assembler can easily, accurately, and quickly fit the flange 64 to the sole structure 12, with the flange 64 in the recess 30. The locating features 68, 70 ensure that the upper component 16 is correctly positioned to partially define the foot-receiving cavity 52 when the second module 60 is secured to the first module 50. The at least one second locating feature 70 is complementary to the at least one first locating feature 68. Stated differently, the first locating feature(s) 68 and the second locating feature(s) 70 are cooperatively configured with complementary shapes to interfit. For example, the at least one first locating feature 68 may be one of a protrusion of, or a recess in, the peripheral side surface 28 of the midsole 17. In the embodiment shown, the first locating features 68 are recesses in the peripheral side surface 28. In fact, the first locating features 68 are further recessed portions of the recess 30. The second locating features 70 are protrusions at the inner surface 66 of the flange 64. The size of the recesses formed by the first locating features 68 is sufficient to receive the second locating features 70. In the embodiment shown, the features 68, 70 locate the flange 64 at the correct position in the recess 30 for subsequent permanent securing of the flange 64 to the midsole 17 in the recess 30. As shown in FIG. 1, when the flange 64 is correctly positioned in the recess 30 using the locating features 68, 70, an outer surface 71 of the flange 64 is flush with an adjacent portion 75 of the peripheral side surface 28 at both the medial side 32 and the lateral side 36 when the inner surface 66 of the flange 64 and the peripheral side surface 28 of the sole structure 12 are fit against and secured to one another with the flange 64 in the recess 30. Stated differently, a thickness T of the flange 64 (see FIG. 4) is the same as the depth D of the recess 30 (see FIG. 2) at portions of the recess 30 not at the locating features 68, so that the outer surface 71 is flush with the peripheral side surface 28 at the adjacent portion 75 (see FIG. 1). Additionally, a medial end 65 of the flange 64 is at the medial end 42 of the recess 30, and a lateral end 67 of the flange 64 is at the lateral end 44 of the recess 30.

The flange 64 can be secured to the midsole 17 in a variety of different ways. For example, an adhesive layer can be applied to the surface 28 that cures to bond the flange 64 to the midsole 17. Alternatively, the flange 64 can be thermally bonded to the midsole 17. For example, the flange 64 can be a material that can be heated to fuse to the midsole 17. The midsole 17 can be a similar material to the flange 64. For example, both the flange 64 and the midsole 17 may be a polymer foam, such as but not limited to a thermoplastic polymer foam or a thermoset polymer foam. By way of non-limiting example, the foam may be a polyurethane (PU) foam (also referred to as a PU-based foam) or an ethylene-vinyl acetate (EVA) foam (also referred to as an EVA-based foam), and in some embodiments may include heat-expanded and molded EVA foam pellets. The upper component 16 may be a first material, including a composite of a number of different materials, such as textiles and foam, and the flange 64 may be a second material different than the first material.

The upper component 16 may be a first material, including a composite of a number of different materials, such as textiles and foam, and the flange 64 may be a second material different than the first material.

Alternatively, the locating features 68, 70 may sufficiently mechanically secure the flange 64 to the midsole 17. For example, if the recesses of the first locating features 68 and the protrusions of the second locating features 70 are sufficiently sized to provide an interference fit, the flange 64 may snap fit to the midsole 17 via the interfitting locating features 68, 70 (i.e., with the first locating features 68 as female connectors) and the second locating features 70 as male connectors, without heating or adhesive required.

As is evident in FIG. 2, the additional upper component 16 is spaced apart from the at least one recess 30 to which the flange 64 of the second module 60 secures. Stated differently, the upper component 16 does not overlap or enter into the recess 30. Accordingly, when the flange 64 of the second module 60 is secured to the peripheral side surface 28 of the sole structure 12 in the recess 30, the additional upper component 16 is adjacent to the upper component 14. In the embodiment shown, the upper component 14 overlaps the mule portion of the upper component 16 in the heel region 22, and slightly overlaps the upper component 16 at the medial side 32 and at the lateral side 36 in the midfoot region 20. The perimeter of the upper component 16 is represented with hidden lines in FIG. 1 where it is overlapped by the upper component 14. The upper component 14 is outward of the upper component 16 where it overlaps upper component 16, so that the upper component 14 defines the outer surface of the footwear 10 in the heel region.

The footwear 10 may include stitching 72 that secures the upper component 14 to the upper component 16. Stitching 72 is shown at the medial side 32 in FIG. 1, and may also be used at the lateral side 36 in the same manner. With reference to FIG. 5, loops 74 are shown sewed to the medial edge 76 and the lateral edge 78 of the upper component 14. The loops 74 are used for handling the upper component 14 during the method of manufacturing, but are cut off of the upper component 14 prior to stitching the upper component 14 to upper component 16. The upper component 14 has eyelets 77 or other lace-receiving or fastening features that are disposed at the medial side 32 and the lateral side 36 when the module 60 is secured to the module 50.

Figure 3:
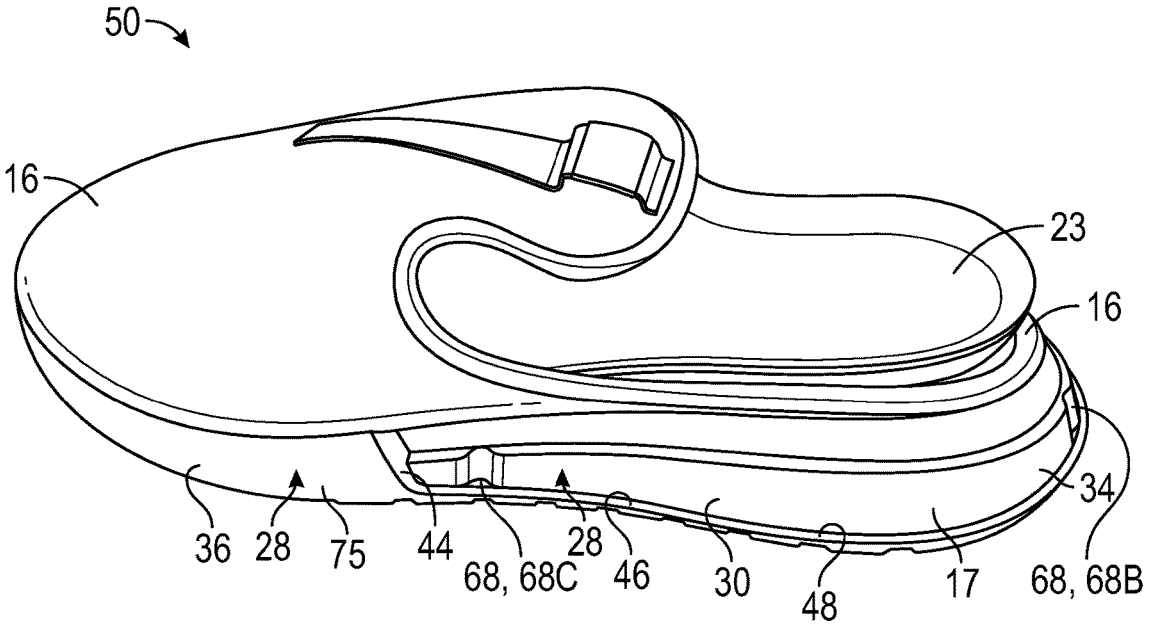
FIG. 3 is a schematic illustration in perspective side view of a lateral side of the first module of FIG. 2.

As best shown in FIGS. 2 and 3, the peripheral side surface 28 of the sole structure 12 has a curvature at the recess 30, such as but not limited to a curvature at the rear periphery 34 of the sole structure 12 which curves generally in a U-shape from the medial side 32 to the lateral side 36. The materials of the upper component 14 and the flange 64 are chosen so that they are sufficiently flexible to adopt a first state (shown in FIGS. 4 and 5) when the flange 64 is disjoined from the sole structure 12, and a second state (shown in FIG. 1) when the flange 64 is secured to the sole structure 12 in the recess 30. The inner surface 66 of the flange 64 has the curvature of the peripheral side surface 28 in the second state. The second module 60 with the flange 64 and the upper component 14 are relatively flat in the first state in comparison to the second state. This may be advantageous for some customization processes that are more optimally performed with the second module 60 relatively flat. For example, various printing techniques that may be used for customization can be performed with the module 60 in the first state. FIG. 1 shows a printed image 80 on the upper component 14 that is a specified characteristic requested by a customer. Stated differently, the printed image 80 is a requested customization of the upper. For purposes of example, the printed image 80 is the number "2" printed on the medial side 32. Although not shown, the printed image 80 may also be printed on the lateral side 36 in addition to or instead of the medial side, or may be on the inner surface of the upper component 14 instead of the outer surface. In other embodiments, the printed image could be a picture, a shape, or text, such as initials, a proper name, a nickname, a team name, or a slogan.

Figure 7:
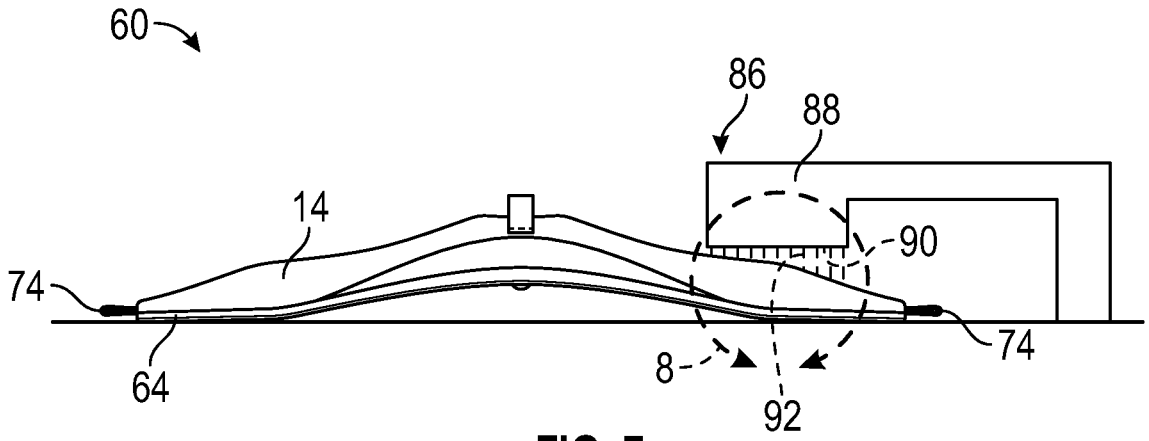
FIG. 7 is a schematic illustration of the second module of FIG. 4 on a printing assembly during customization.
Figure 8:
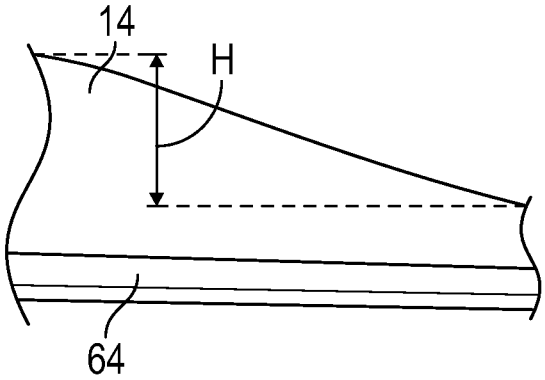
FIG. 8 is a close up fragmentary view of a portion of the second module of FIG. 8.

Some printing apparatuses or printing techniques are more accurate when the printer head is maintained relatively close to the surface to be printed. In one example embodiment, a predetermined region 82 (i.e., the region within the phantom circle in FIG. 4) of a surface 84 of the upper component 14 has a maximum variance in elevation H of less than or equal to 10 millimeters in the first state. The variance in elevation H is represented in FIG. 8. Such a variance in elevation H enables a customized graphical image such as printed image 80 to be applied on the upper component 14 at the predetermined region 82 with an ink jet printer 86 shown in FIG. 7. The printer 86 has a printer head 88 that prints most optimally when the surface to be printed is disposed within a 10 millimeter range from the ink nozzle 90 (with multiple nozzles 90 in the printer head 88). Ink 92 is shown being applied in FIG. 7. Accordingly, in the example embodiment, the predetermined region 82 of the surface 84 of the upper component 14 has a graphical image 80 thereon and the graphical image is comprised of ink. Alternatively, other types of printers may be used to apply a graphical image, or the graphical image may be applied by heat transfer, sewn onto the upper component 14, or woven or otherwise provided in the material of the upper component 14.

Figure 28:
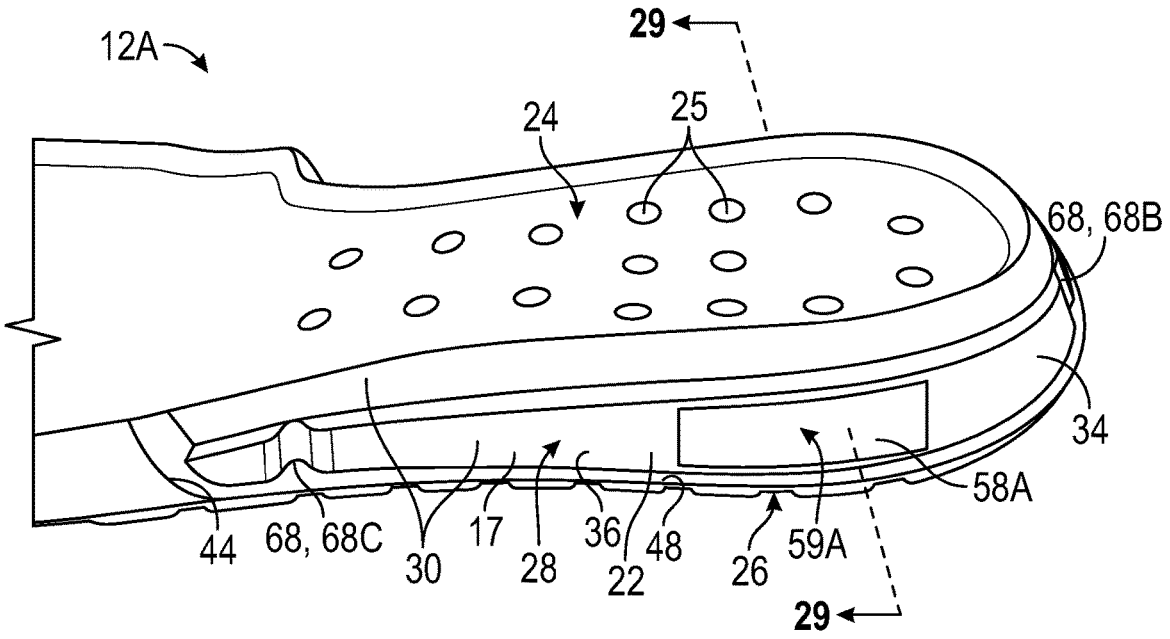
FIG. 28 is a schematic illustration in fragmentary perspective view of an alternative sole structure of the first module of FIG. 2.
Figure 29:
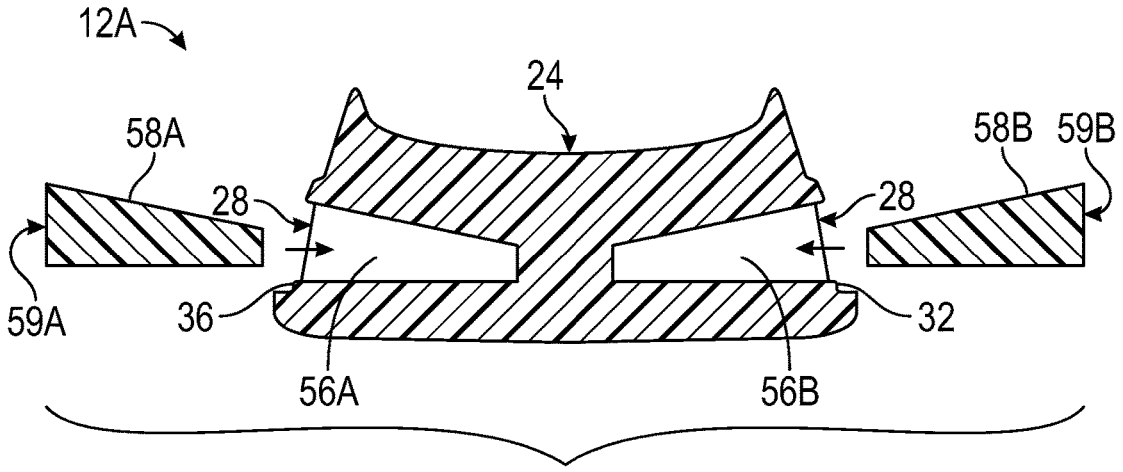
FIG. 29 is a schematic illustration in exploded cross-sectional view of the sole structure of FIG. 28.

FIGS. 28-31 show alternative sole structures 12A, 12B that can be customized in accordance with a request for a specified stiffness or stability characteristic. The sole structures 12A and 12B are like sole structure 12 in all aspects except that they are provided with a cavity at the peripheral side surface 28 in either or both of the medial side 32 and the lateral side 36. More specifically, sole structure 12A has a cavity 56A at the lateral side 36, and a cavity 56B at the medial side 32, both of the cavities 56A, 56B disposed generally in the heel region 22. The cavities 56A, 56B may be generally wedge-shaped, tapering in height in an inward direction from the peripheral side surface 28. However, other shapes of cavities and inserts may be used within the scope of the present teachings. As indicated in FIG. 29, a lateral insert 58A is sized and shaped to fit within the lateral cavity 56A generally so that the lateral cavity 56A is completely filled by the lateral insert 58A, and an outer surface 59A of the lateral insert 58A is flush with the peripheral side surface 28. The insert 58A may be a material that has a different compressive stiffness than the material of the sole structure 12A. Accordingly, when the insert 58A is placed in the cavity, the sole structure 12A with the insert 58A therein provides the specified stiffness or stability characteristic. For example, the insert 58A may be stiffer than the material of the sole structure 12.

The lateral insert 58A may be permanently secured to the sole structure 12A within the cavity 56A such as with adhesive. Alternatively, the lateral insert 58A may be interference fit to the sole structure 12A within the cavity 56A so that it is selectively removable from the cavity 56A without damage to the sole structure 12A. This would enable an alternative insert with a different stiffness characteristic to be used at a different time if a wearer desires a different stiffness or stability characteristic. For example, multiple sets of inserts may be provided, and a wearer could select a first lateral insert 58A for some activities, and a second lateral insert 58A for other activities, with the second lateral insert 58A being stiffer than the first lateral insert 58A.

Similar to the lateral insert 58A, the medial insert 58B is sized and shaped to fit within the medial cavity 56B generally so that the medial cavity 56B is completely filled by the medial insert 58B, and an outer surface 59B of the medial insert 58B is flush with the peripheral side surface 28. The insert 58B may have a different compressive stiffness than the sole structure 12A. Accordingly, when the insert 58B is placed in the cavity, the sole structure 12A with the insert 58B therein provides the specified stiffness or stability characteristic. For example, the insert 58B may be a material with a greater compressive stiffness than the material of the sole structure 12. Like the lateral insert 58A, the medial insert 58B may be permanently secured in the cavity 56B such as with adhesive, or may be removably press-fit in the cavity 56B. Optionally, the lateral insert 58A and the medial insert 58B may have different stiffnesses than one another. For example, the medial insert 58B may be stiffer than the lateral insert to satisfy a stability characteristic, such as enhanced medial support to prevent overpronation.

To enable alternate sets of inserts to be used with the sole structure 12A, the sole structure 12A with inserts 58A, 58B is best provided with an upper component that is removably securable to the sole structure 12A ((rather than adhered), such as with a mechanical connection between the flange of the upper component and the sole structure, as described herein. Once the inserts 58A, 58B are placed in the cavities 56A, 56B, the flange of the upper component will cover the opening of the cavity 56A, 56B at the peripheral side surface 28, further securing the inserts 58A, 58B in the cavities 56A, 56B. Although two cavities and two inserts are shown in FIGS. 28-29, the sole structure 12A may have only one cavity or more than two cavities for receiving an equal number of inserts, and the cavities may be located elsewhere than the heel region 22, such as in the forefoot region 18 or the midfoot region 20.

Figure 30:
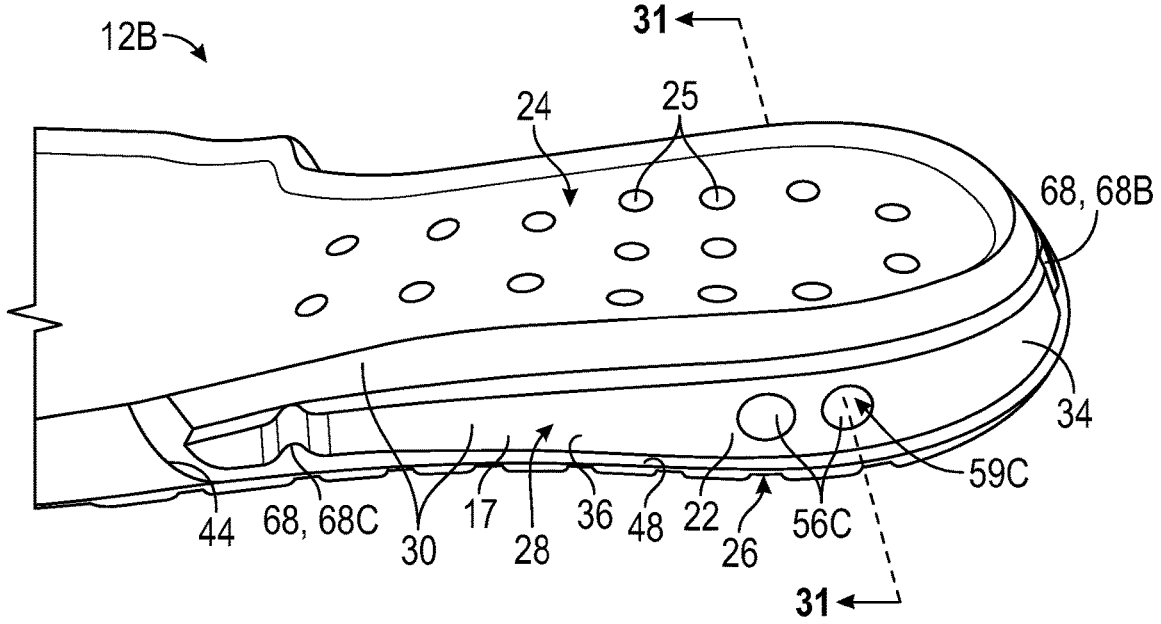
FIG. 30 is a schematic illustration in fragmentary perspective view of another alternative sole structure of the first module of FIG. 2.
Figure 31:
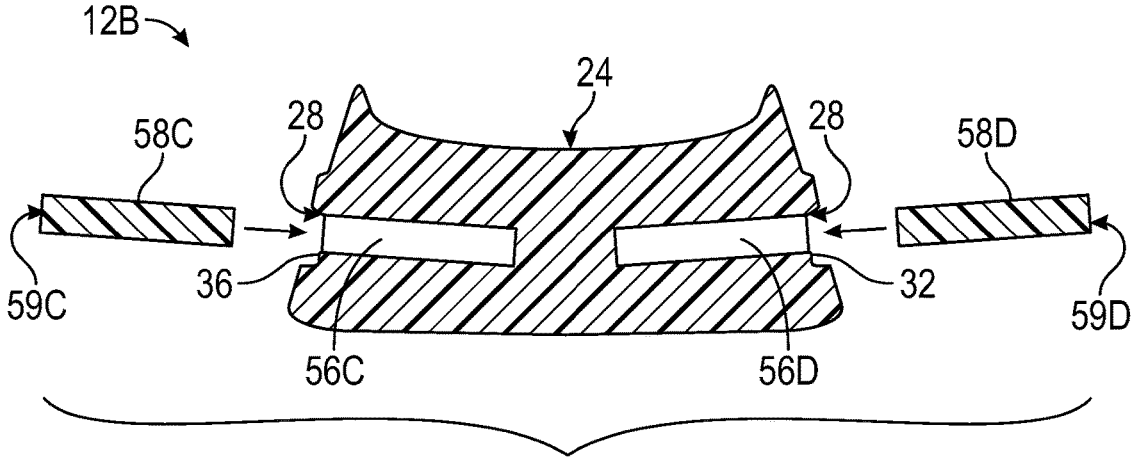
FIG. 31 is a schematic illustration in exploded cross-sectional view of the sole structure of FIG. 30.

FIGS. 30-31 show another alternative embodiment of a sole structure 12B that has two cavities 56C at the lateral side 36, and two cavities 56D at the medial side 32. Only one of the cavities 56D is visible in the cross-section of FIG. 31, but the medial side 32 has another identical cavity 56D positioned forward of the cavity 56D shown, similar to the relative positions of cavities 56A. Although two cavities are at each of the medial and lateral sides in the embodiment shown, in other embodiments, only one of the sides 32, 36 may have a cavity, or both of the sides 32, 36 may have multiple cavities. The cavities 56C, 56D are disposed generally in the heel region 22, but may instead be disposed in another region of the sole structure 12B.

The cavities 56C, 56D are generally cylindrical in shape, extending in an inward direction from the peripheral side surface 28. However, other shapes of cavities and inserts may be used within the scope of the present teachings. As indicated in FIG. 30, each lateral insert 58C is sized and shaped to fit within the lateral cavity 56C generally so that the lateral cavity 56C is completely filled by the lateral insert 58C, and an outer surface 59C of the lateral insert 58C is flush with the peripheral side surface 28. The inserts 58C may be a material that has a different compressive stiffness than the material of the sole structure 12A. Accordingly, when the inserts 58C are placed in the cavities 56C, the sole structure 12A with the inserts 58C therein provides the specified stiffness or stability characteristic. For example, the inserts 58C may be stiffer than the material of the sole structure 12.

Similar to the lateral inserts 58C, each medial insert 58D is sized and shaped to fit within the medial cavity 56D generally so that the medial cavity 56D is completely filled by the medial insert 58D, and an outer surface 59D of the medial insert 58D is flush with the peripheral side surface 28. The inserts 58D may have a different compressive stiffness than the sole structure 12A. Accordingly, when the inserts 58D are placed in the cavities 56D, the sole structure 12A with the inserts 58D therein provides the specified stiffness or stability characteristic. For example, the inserts 58D may be stiffer than the material of the sole structure 12. Like the lateral inserts 58C, the medial inserts 58D may be permanently secured in the cavities 56D with adhesive, or may be removably press-fit in the cavities 56D. Optionally, the lateral inserts 58C and the medial inserts 58D may have different stiffnesses than one another.

To enable alternate sets of inserts to be used with the sole structure 12B, the sole structure 12B with inserts 58C, 58D is best provided with an upper component that is removably securable to the sole structure 12B (rather than thermally bonded or adhered), such as with a mechanical connection between the flange of the upper component and the sole structure, as described herein. Once the inserts 58C, 58D are placed in the cavities 56C, 56D, the flange of the upper component will cover the opening of the cavity 56C, 56D at the peripheral side surface 28, further securing the inserts 58C, 58D in the cavities 56C, 56D. Although two cavities and two inserts are shown in FIGS. 30-31, the sole structure 12B may have only one cavity or more than two cavities for receiving an equal number of inserts, and the cavities may be located in other regions than the heel region 22.

Figure 9:
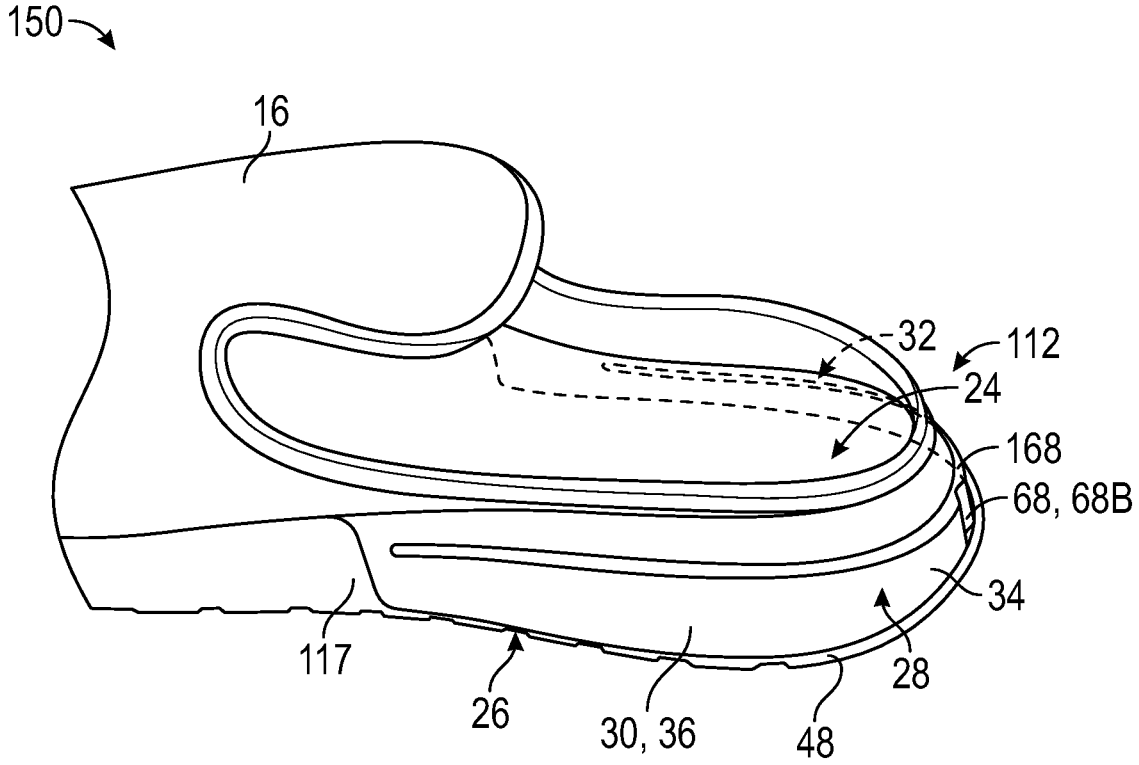
FIG. 9 is a schematic illustration in fragmentary perspective view of an alternative embodiment of a first module.
Figure 14:
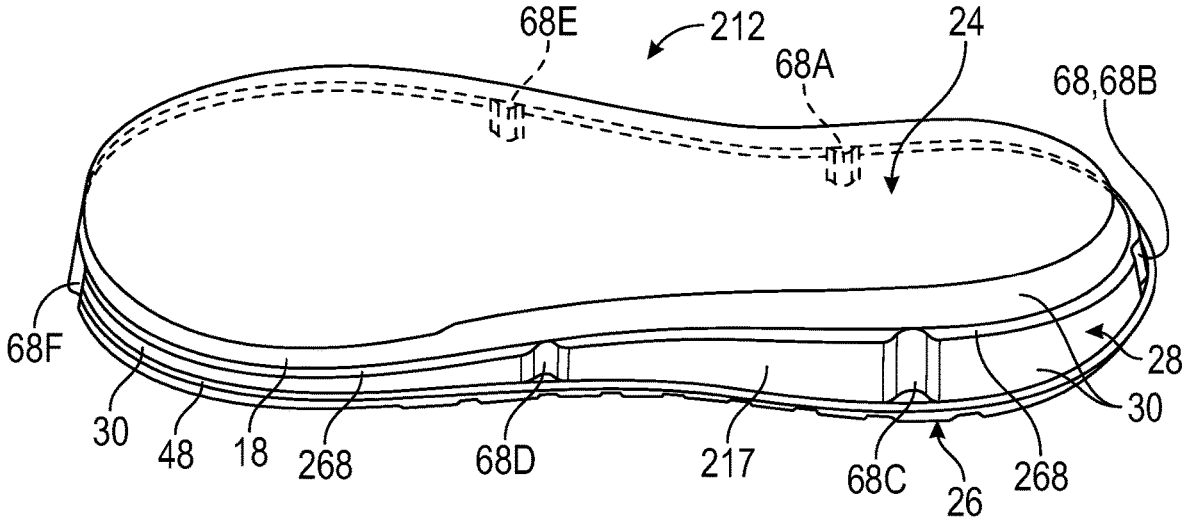
FIG. 14 is a schematic illustration in perspective view of an alternative sole structure for a modular article of footwear.

FIG. 9 shows an alternative embodiment of a sole structure 112 including a midsole 117 that can be used in place of midsole 17 in the module 50 of FIG. 1, or can be used in place of midsole 217 of FIG. 14. The midsole 117 is part of a first module 150 that has many of the same features of midsole 17, as indicated by like reference numbers. Instead of first locating features 68A and 68C, the midsole 117 includes a first locating feature 168 that is a slot. The slot 168 extends in the peripheral side surface 28 along the rear periphery 34 of the sole structure 112 and along the medial side 32 of the sole structure 112 and the lateral side 36 of the sole structure 112. The locating feature 68B as described in FIG. 2 is also included and intersects the slot 168 at the rear periphery 34.

Figure 10:
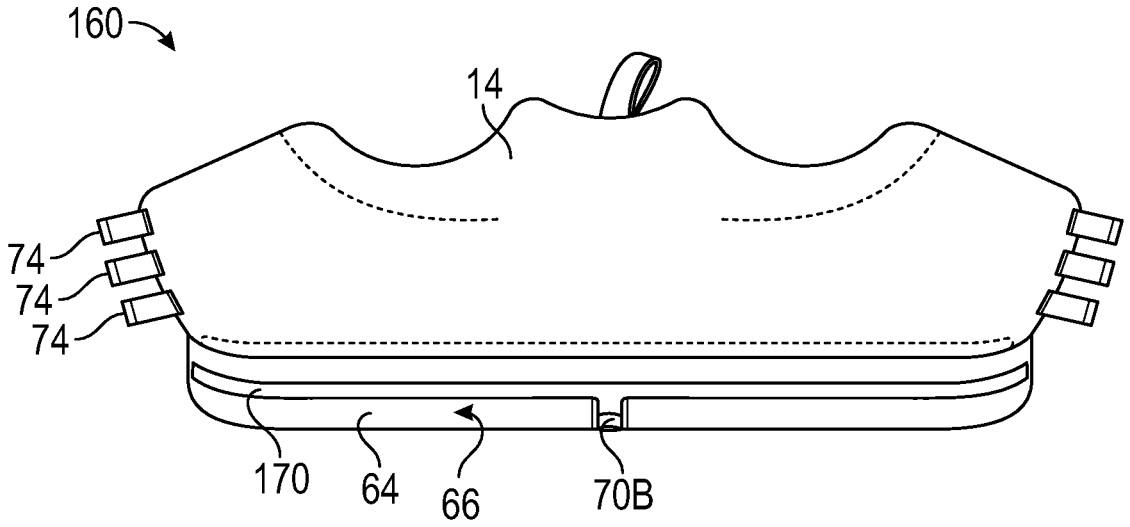
FIG. 10 is a schematic illustration in plan view of an alternative second module.
Figure 11:
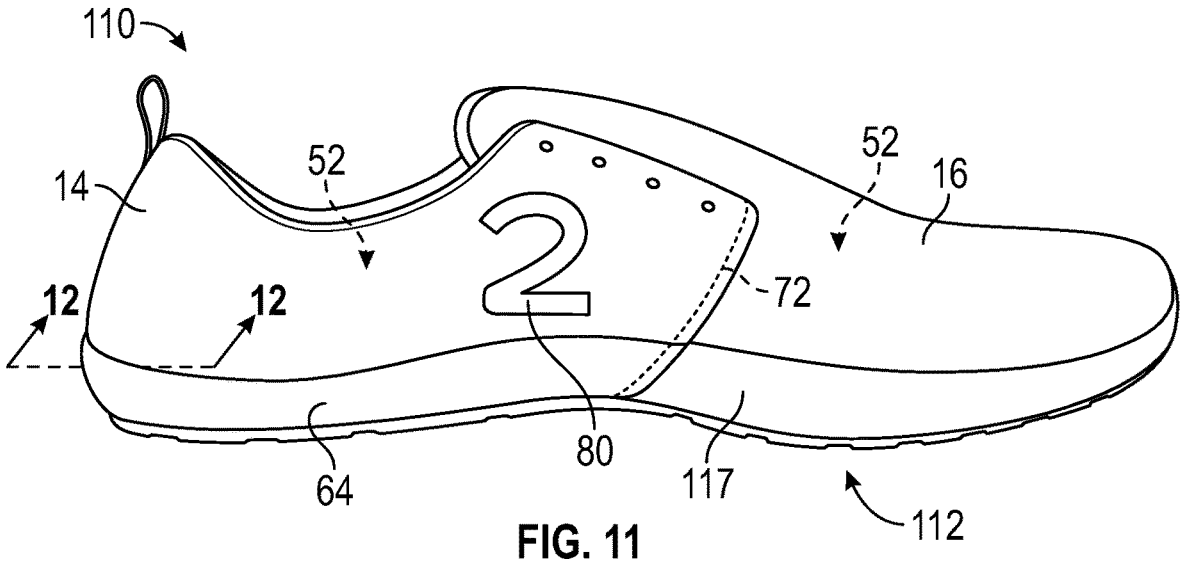
FIG. 11 is a schematic illustration in perspective side view of an embodiment of a modular article of footwear including the modules of FIGS. 9 and 10.
Figure 12:
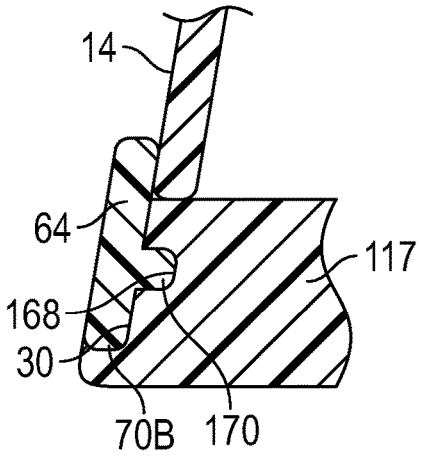
FIG. 12 is a schematic illustration in fragmentary cross-sectional view of the article of footwear of FIG. 11 taken at lines 12-12 in FIG. 11.

FIG. 10 shows a second module 160 that has many of the same features as second module 60, as indicted by like reference numbers. Instead of second locating features 70A and 70C, the flange 64 includes a second locating feature that is a ridge 170 that protrudes at the inner surface 66 of the flange 64. The locating feature 70B as described in FIG. 2 is also included and intersects the ridge 170. The sole structure 112 and the flange 64 may mechanically secure to one another when the ridge 170 is aligned with and placed into the slot 168. The ridge 170 can be aligned with the slot 168 by aligning the locating feature 70B with locating feature 68B, so that the module 160 can be easily secured to the sole structure 112 during the customization process. For example, the ridge 170 is a male connector, and the slot 168 is a female connector. FIG. 11 shows an article of footwear 110 including the modules 150 and 160. The upper components 14, 16 each partially define a foot-receiving cavity 52 when secured to the sole structure 112 in an article of footwear 110. FIG. 12 depicts the ridge 170 in the slot 168 when the second module 160 is secured to the first module 150, in a cross-sectional view taken at lines 12-12 in FIG. 11.

Figure 13:
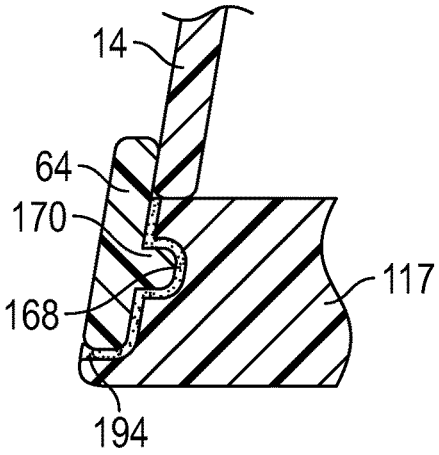
FIG. 13 is a schematic illustration in fragmentary cross-sectional view of the article of footwear of FIG. 11 with the second module of FIG. 10 interfit with and secured to the first module of FIG. 9 in an alternative manner.

FIG. 13 shows that, instead of or in addition to mechanical connectors, an adhesive 194 may be disposed on either or both of the inner surface 66 of the flange 64 and the peripheral side surface 28 of the sole structure 112 to secure the flange 64 to the sole structure 112. In some embodiments, the adhesive 194 may be a hot melt adhesive.

FIG. 14 shows an embodiment of a sole structure 212. The sole structure 212 has many of the same features as sole structure 12, and these are referred to with like reference numbers. First locating features 68A, 68B, and 68C are described with respect to FIGS. 2 and 3, as well as additional first locating features 68D, 68E and 68F are provided as recesses in the peripheral side surface 28 at the recess 30. The recess 30 extends around the entire peripheral side surface 28, including in the forefoot region 18, rather than stopping at ends 42, 44 at the midfoot region 20 as in FIGS. 2 and 3. A slot 268 similar to slot 168 extends around the entire peripheral side surface 28 and serves as a first locating feature that is a female connector. Although six locating features are shown on the sole structure 212, in other embodiments, fewer locating features, such as one, two, three, four, or five locating features may be used. The one or more flanges secured to the sole structure 212 have an equal number of locating features corresponding to those on the sole structure 212.

Figure 15:
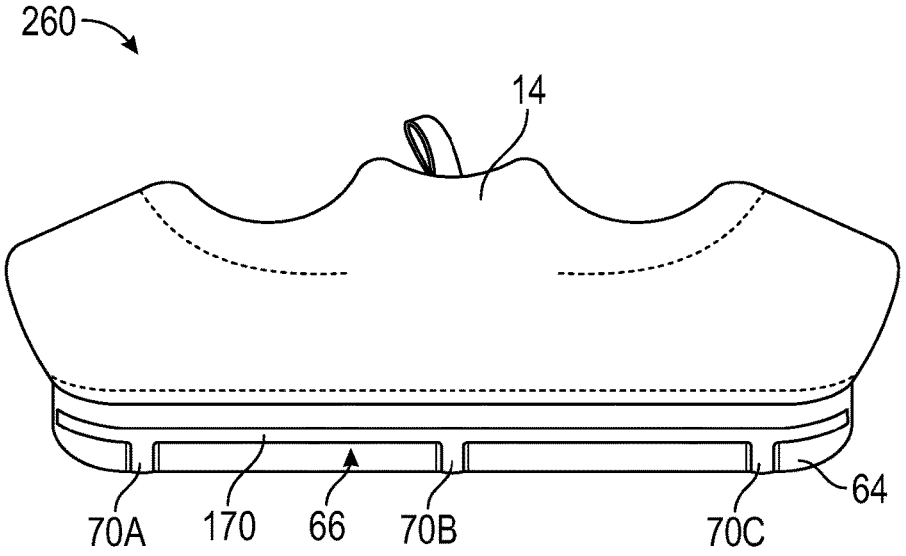
FIG. 15 is a schematic illustration in plan view of a module with a first upper component and a first flange securable to the sole structure of FIG. 14.
Figure 16:
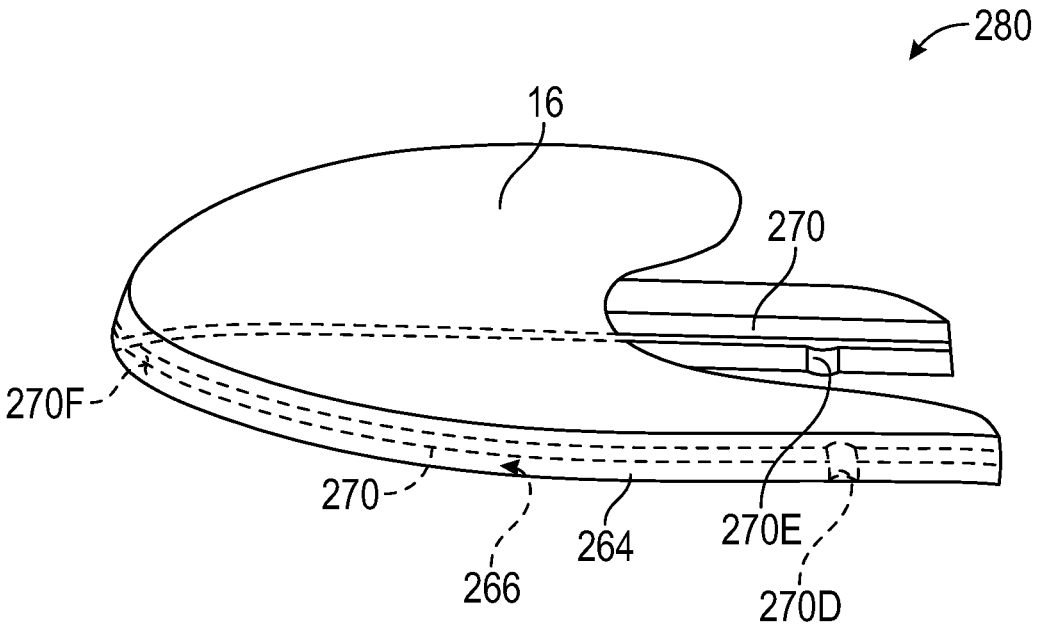
FIG. 16 is a schematic illustration in plan view of a module with a second upper component and a second flange securable to the sole structure of FIG. 14.

The sole structure 212 has no upper components secured to it prior to the start of the customization process. In other words, even the upper component 16 is not secured to the sole structure 212. More than one module may be separate from the sole structure 212 prior to a request for a specified characteristic (i.e., a customization request), and secured to the sole structure 212 during the customization process. Each such module includes a flange and an upper component. For example, the module 260 of FIG. 15 and the module 280 of FIG. 16 can both be customized and secured to the midsole 217 during the customization process. The module 260 includes upper component 14 as a first upper component, and the flange 64 as a first flange. The flange 64 has second locating features 70A, 70B and 70C, which are protrusions at the inner surface 66 of the flange 64. The flange 64 also has the ridge 170 as a male connector protruding at the inner surface 66. The flange 64 fits in the recess 30 with the locating features 70A, 70B, 70C aligned with the locating features 68A, 68B, 68C, respectively, and with the ridge 170 in the slot 268 to mechanically secure the module 260 to the sole structure 212.

Figure 17:
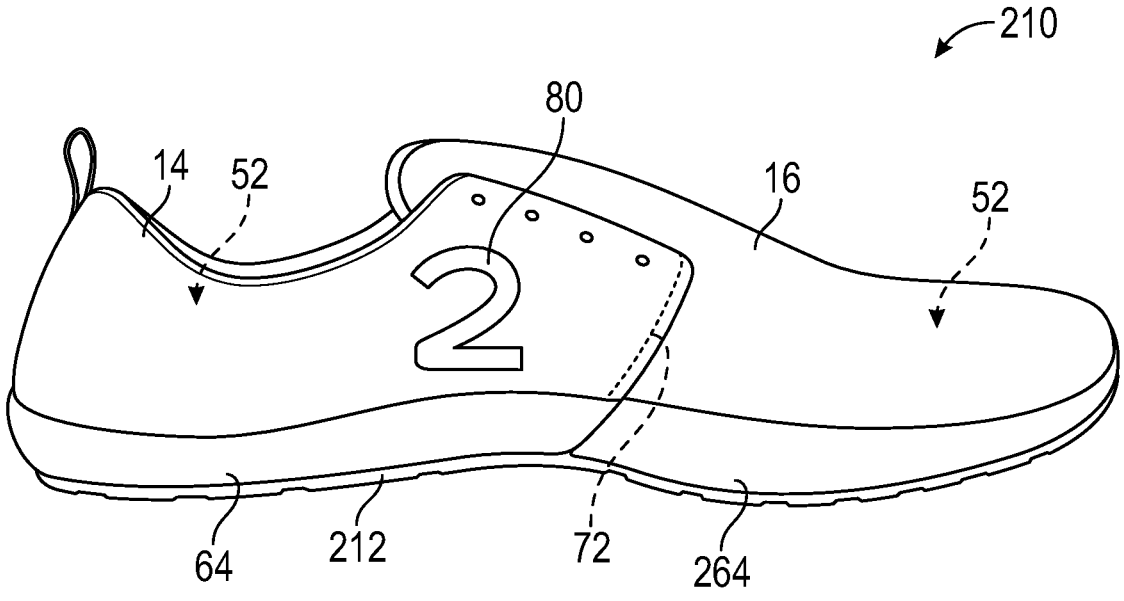
FIG. 17 is a schematic illustration in side view of an embodiment of a modular article of footwear including the modules of FIGS. 14-16.

The second module 280 comprises the second upper component 16, and a second flange 264 secured to the second upper component 16 and projecting therefrom. An inner surface 266 of the second flange 264 has locating features 270D, 270E, and 270F, as well as a protruding ridge 270 that serves as a male connector feature. An inner surface 266 of the second flange 264 fits against the peripheral side surface 28 of the sole structure 212 with the second flange 264 in the recess 30, the locating features 270D, 270E, and 270F aligned with the locating features 68D, 68E, and 68F, respectively, and the ridge 270 serving as a male connector feature that fits into the female connector feature (i.e., slot 268) to mechanically secure the module 280 to the sole structure 212. The upper components 14, 16 each partially define a foot-receiving cavity 52 when secured to the sole structure 212 in an article of footwear 210 as shown in FIG. 17. Upper component 16 serves as a forefoot region of a modular upper 14, 16, and upper component 14 serves as a heel region of a modular upper 14, 16. In such an embodiment, when the second flange 264 is secured to the peripheral side surface 28 of the sole structure 212 in the recess 30, the second upper component 16 is adjacent to the first upper component 14, and the article of footwear may have stitching that secures the second upper component 16 to the first upper component 14 which may be identical to stitching 72 of FIG. 1.

Figure 18:
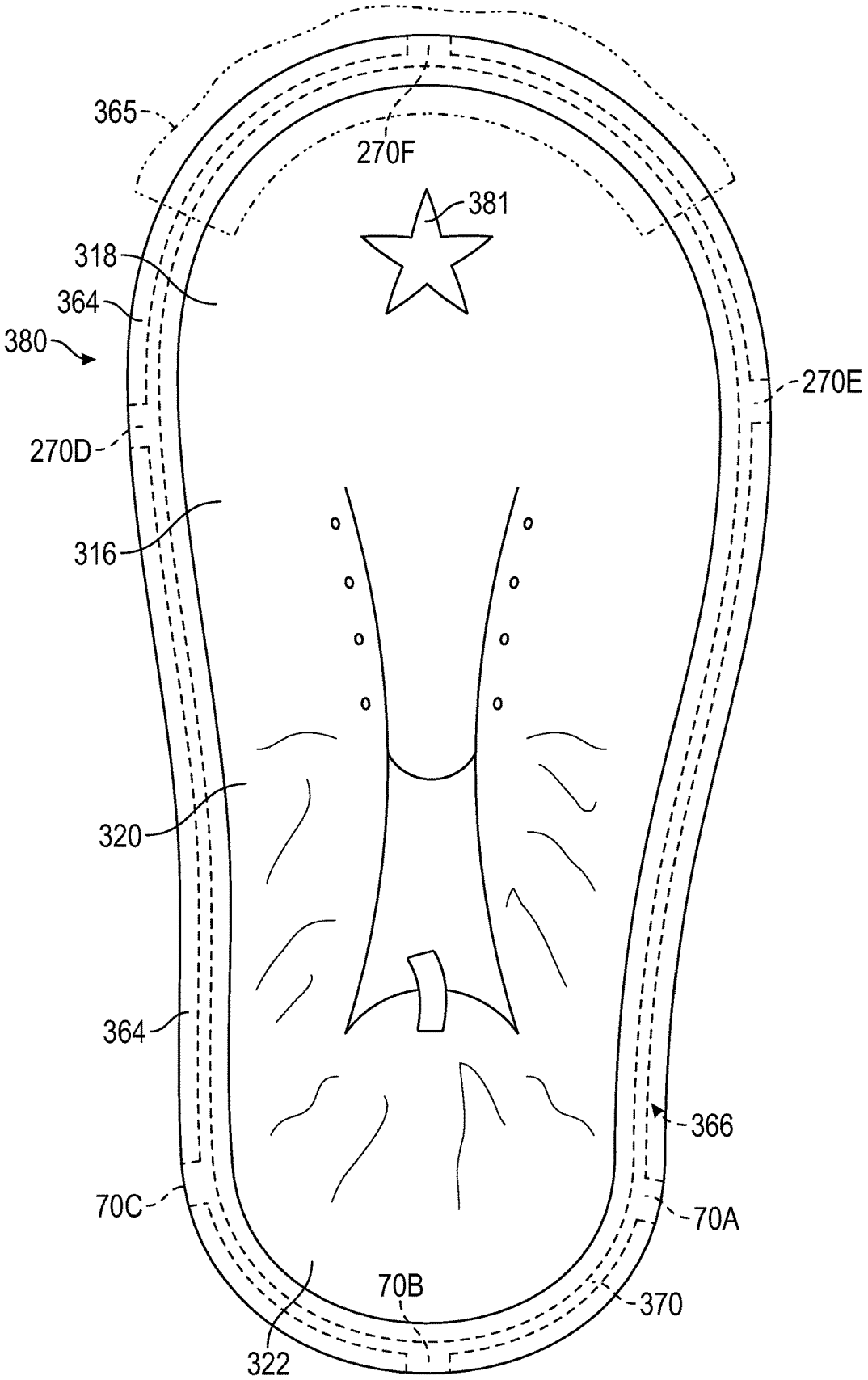
FIG. 18 is a schematic illustration in plan view of a module with an upper component and a flange securable to the sole structure of FIG. 14.
Figure 19:
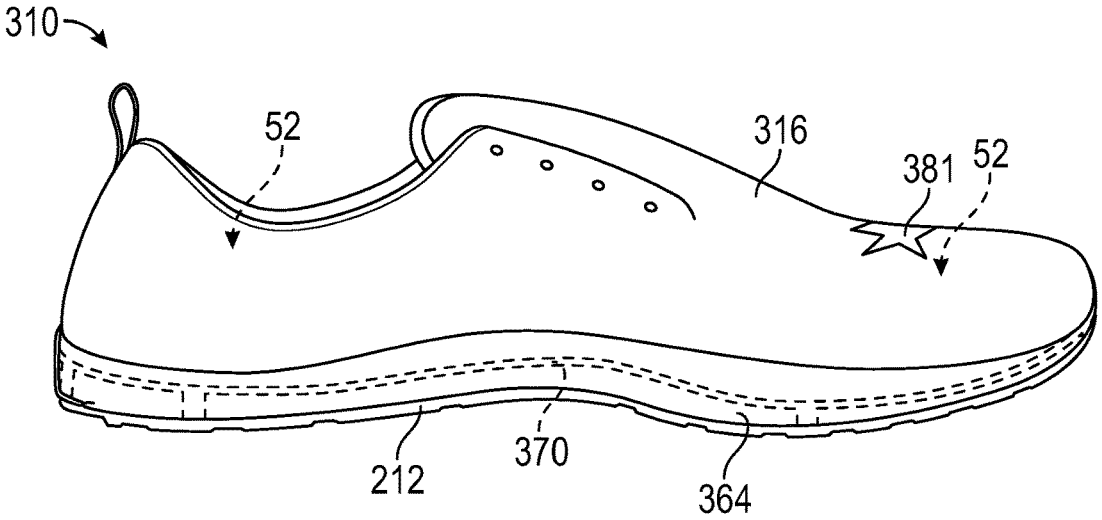
FIG. 19 is a schematic illustration in side view of an embodiment of a modular article of footwear including the module of FIG. 18.

FIG. 18 shows an alternative embodiment of a second module 380 for use with the sole structure 212 of FIG. 14 or another similar sole structure having a single recess 30. The second module 380 includes an upper component 316 that includes a forefoot region 318, a midfoot region 320, and a heel region 322 corresponding with the forefoot region 18, the midfoot region 20, and the heel region 22 of the sole structure 212. The second module 380 includes a single flange 364 extending around the periphery of the upper component 316 at the forefoot region, the midfoot region, and the heel region of the upper component 316. The upper component 316 is a first material, and the flange 364 is a second material such as polymer foam. For example, the flange 364 may be a thermoplastic polymer foam or a thermoset polymer foam. The polymer foam of the flange may be the same polymer foam as the material of the sole structure to which the flange is to be attached. In the embodiment shown, the flange 364 is a single, continuous flange. The flange 364 establishes the lower periphery of the second module 380, and has a ridge 370 extending around the entire flange 364 with second locating features 70A-70F as described herein.

The upper component 316 is a single, unitary, one-piece upper component, and is shown in a flattened state in FIG. 18 gathered or bunched inward of the flange 364. The second module 380 is maintained in a relatively flattened state by a jig 365 shown in phantom in preparation for customization by printing or otherwise, as described with respect to FIG. 7. The jig 365 is shown at the forefoot region 318 in the example embodiment as the forefoot region 318 is to undergo a secondary customization process such as printing a graphical image 381 on the upper component 316 at the forefoot region 318. However, the jig 365 may have a different configuration and/or may be secured to other portions of the second module 380 such as for customization of the heel region, the lateral side, or otherwise. Following customization, the second module 380 is removed from the jig 365, and may be returned to an unflattened state. The ridge 370 is aligned with the slot 268 of the sole structure 212, with the additional second locating features 70A-70F aligned with the corresponding additional first locating features 68A, 68F. The inner surface 366 of the flange 364 is fit against and secured to the peripheral side surface 28 of the sole structure 212 by any of the methods described herein.

Figure 20:
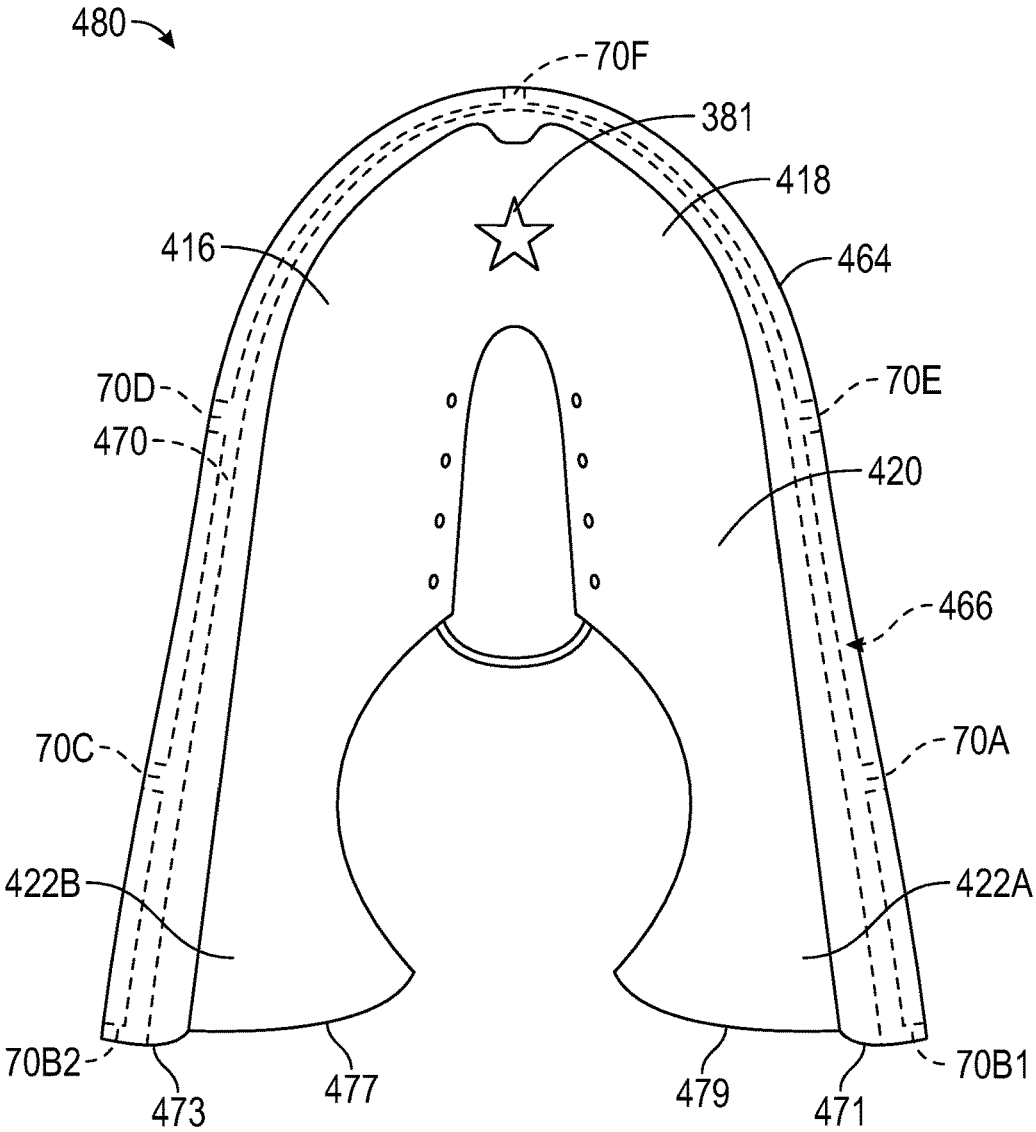
FIG. 20 is schematic illustration in plan view of a module with an upper component and a flange securable to the sole structure of FIG. 14.

FIG. 20 shows an alternative embodiment of a second module 480 for use with the sole structure 212 of FIG. 14 or another similar sole structure having a single recess 30. The second module 480 includes a single, one-piece, unitary upper component 416 that includes a forefoot region 418, a midfoot region 420, and a heel region 422 corresponding with the forefoot region 18, the midfoot region 20, and the heel region 22 of the sole structure 212. The second module 480 includes a single flange 464 extending along the periphery of the upper component 416 at the forefoot region, the midfoot region, and the heel region of the upper component 416. In a pre-assembly state in which the second module 480 is ready for a secondary customization process, the upper component 416 has a split in the heel region 422, separating the heel region 422 into a medial side heel region 422A and a lateral side heel region 422B. The split heel region helps the upper component 416 maintain a relatively flat state optimal for some secondary processes as described herein, such as printing a graphical image 381 at the forefoot region.

The upper component 416 is a first material, and the flange 464 is a second material such as polymer foam. For example, the flange 464 may be a thermoplastic polymer foam or a thermoset polymer foam. The polymer foam of the flange may be the same polymer foam as the material of the sole structure to which the flange is to be attached. The flange 464 has a first end 471 at the medial side split heel region 422A, and a second end 473 at a lateral side split heel region 422B. A jig (not shown) similar to jig 365 of FIG. 18 may be used to hold the second module 480 in its pre-assembly state of FIG. 20 during customization by secondary processing steps. The flange 464 establishes the lower periphery of the second module 480, and has a ridge 470 extending around the entire flange 464 with second locating features 70A-70F as described herein. Locating feature 70B may have two halves 70B1 and 70B2 at the respective first and second ends 471, 473 of the flange 464.

Following customization, the second module 480 is removed from any jig used to secure it during customization. A lateral edge 477 of the upper component 416 at a lateral side of the split heel region 422B is then secured to a medial edge 479 of the upper component in a medial side of the split heel region 422A, and the second module 480 is then no longer in a flattened state. Optionally, a strobel is secured along the lower edge of the upper component 416 inward of the flange 464. Following these steps, the ridge 470 is aligned with the slot 268 of the sole structure 212, with the second locating features 70A-70F aligned with the corresponding first locating features 68A, 68F. The two halves 70BA and 70BB are adjacent one another in the second locating feature 68B when the inner surface 466 of the flange 464 is fit against and secured to the peripheral side surface 28 of the sole structure 212 by any of the methods described herein.

Figure 21:
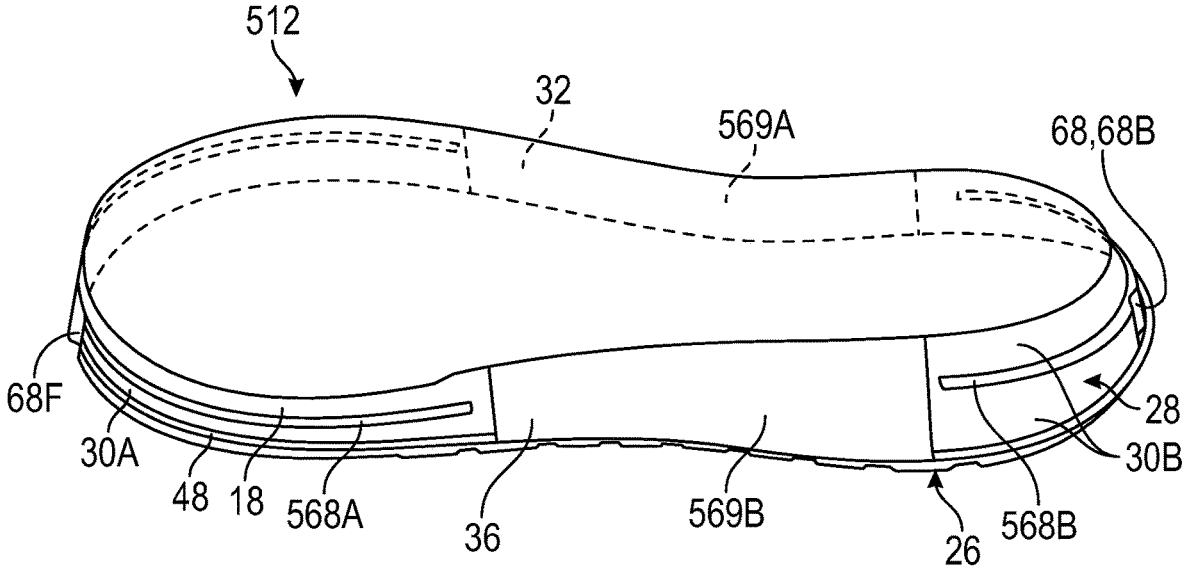
FIG. 21 is a schematic illustration in perspective view of an alternative sole structure for a modular article of footwear.
Figure 25:
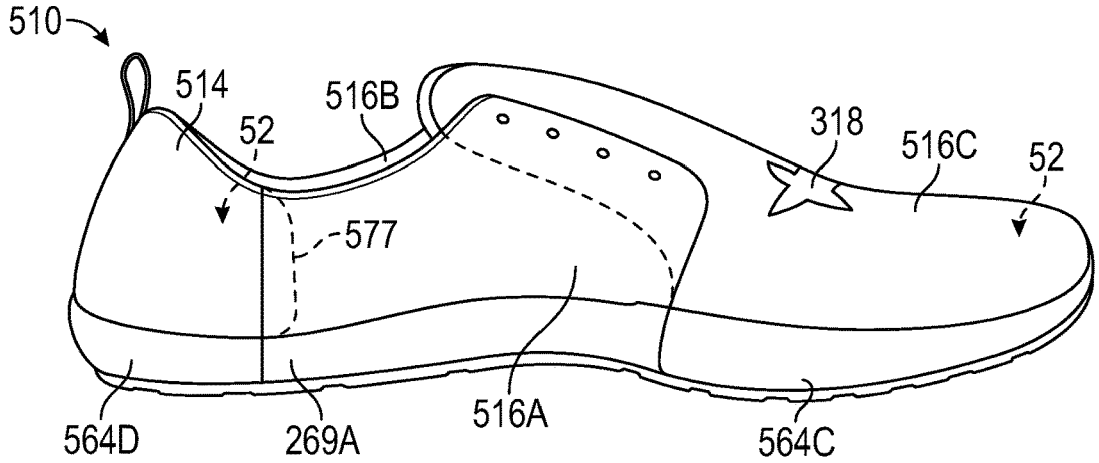
FIG. 25 is a schematic illustration of a modular article of footwear including the modules of FIGS. 22-24.

FIG. 21 shows another embodiment of a sole structure 512 for use in a modular article of footwear 510 of FIG. 25. The sole structure 512 has a first recess 30A and a second recess 30B. The second recess 30B is separated from the first recess 30A by a non-recessed portion 569A of the peripheral side surface 28 on the medial side 32 of the sole structure 512, and by a non-recessed portion 569B of the peripheral side surface 28 of the sole structure 512 on the lateral side 36 of the sole structure. In other embodiments, the positions of the first and second recesses and the non-recessed portions can be switched, for example, with the non-recessed portions 569A, 569B instead at the front and rear of the sole structure 512, respectively, and the first recess 30A and second recess 30B at the lateral side 36 and the medial side 32, respectively. The first recess 30A includes a first locating feature 568A that is a slot, and also includes an additional first locating feature 68F. The second recess 30B includes a first locating feature 568B that is a slot, an also includes an additional first locating feature 68B.

Figure 22:
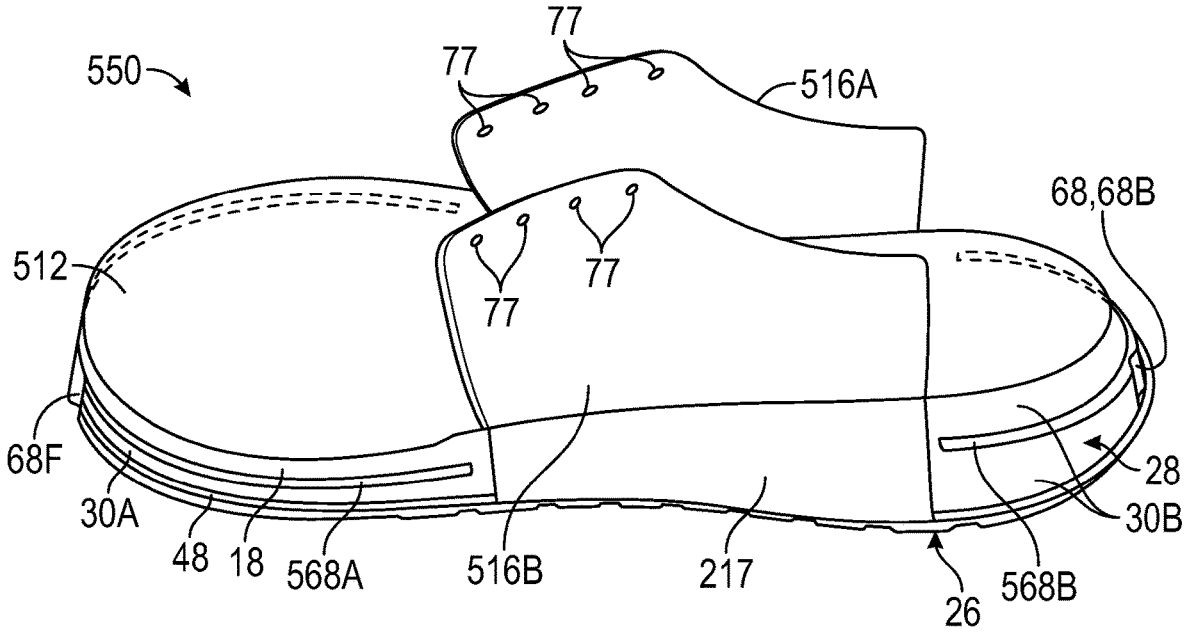
FIG. 22 is a schematic illustration in perspective view of a module that includes the sole structure of FIG. 21 and upper portions secured thereto.

FIG. 22 shows the sole structure 512 as assembled with upper components 516A, 516B secured at the non-recessed portions 569A, 569B, respectively. The upper components 516A, 516B include eyelets 77, and are the portions of the upper potentially subject to the greatest stress when the upper is tightened at the eyelets. By securing the upper components 516A, 516B to the sole structure 512 in an initial pre-customization state, the components 516A, 516B may be secured to the sole structure 512 by any means best able withstand such stress. For example, the upper components 516A, 516B could each include a flange similar to flange 64 discussed herein, with the flanges thermally bonded to the non-recessed portions 569A, 569B, stitched to the sole structure 512 at the non-recessed portions 569A, 569B, or otherwise. A complete range of securement options and methods are available, as the methods for securement of the upper components 516A, 516B need not necessarily be conducive to secondary processes easily carried out at retail locations.

Figure 23:
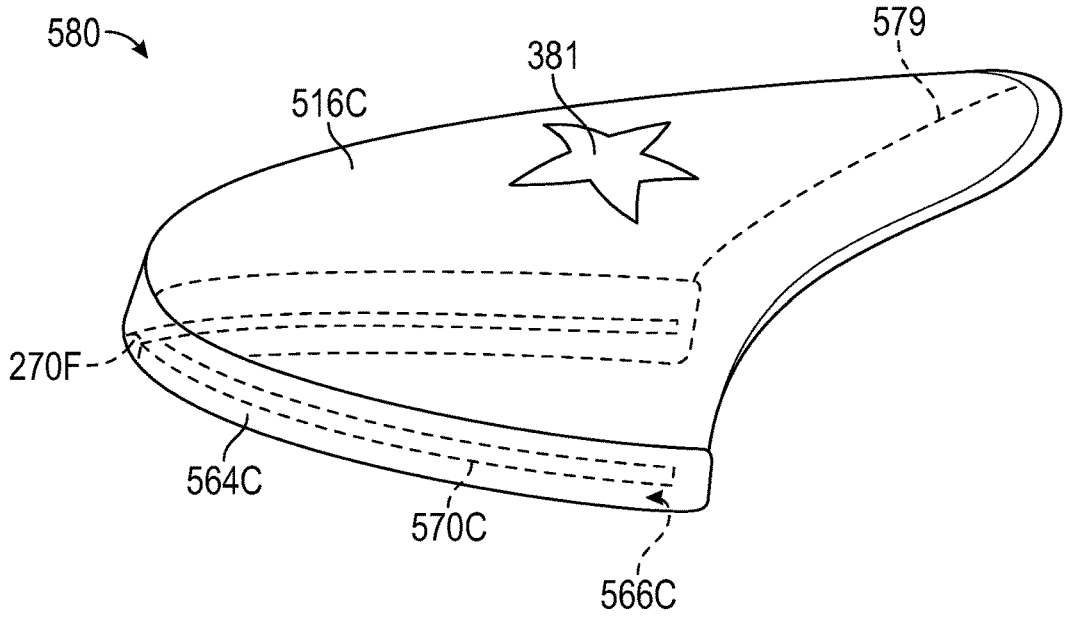
FIG. 23 is a schematic illustration in plan view of another module including a first upper component and a first flange fittable in the first recess of FIG. 21.

FIG. 23 shows a first module 580 that has a first upper component 516C with a first flange 564C secured thereto. The first upper component 516C is generally only a forefoot region in this embodiment. The first upper component 516C is a first material, and the first flange 564C is a second material such as polymer foam. For example, the first flange 564C may be a thermoplastic polymer foam or a thermoset polymer foam. The polymer foam of the flange may be the same polymer foam as the material of the sole structure to which the flange is to be attached. An inner surface 566C of the flange 564C has second locating features including a ridge 570C and a protruding locating feature 270F described herein. The first module 380 is shown with a customized graphical image 381, which may be provided in response to a customer request.

Figure 24:
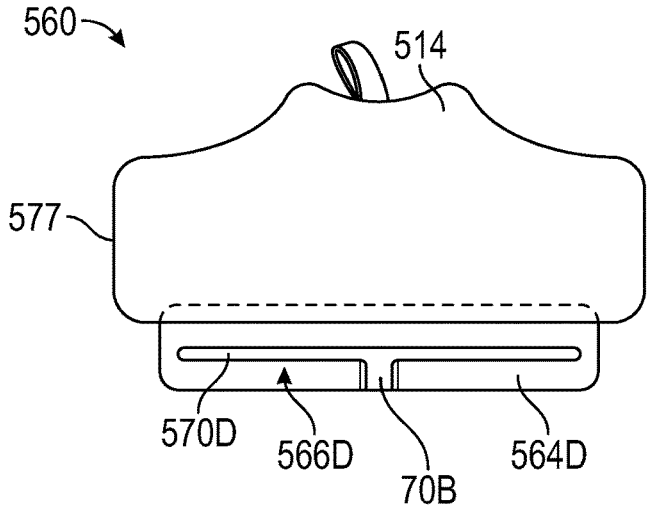
FIG. 24 is a schematic illustration in side view of another module including a second upper component and a second flange fittable in the second recess of FIG. 21.

FIG. 24 shows a second module 560 that includes an upper component 514 with a flange 564D secured thereto. The upper component 514 is referred to as a second upper component, and the flange 564D is referred to as a second flange. The second upper component 514 is generally only a heel region in this embodiment. The second upper component 514 is a first material, and the second flange 564D is a second material such as polymer foam. For example, the second flange 564D may be a thermoplastic polymer foam or a thermoset polymer foam. The polymer foam of the flange may be the same polymer foam as the material of the sole structure to which the flange is to be attached. An inner surface 566D of the flange 564D has second locating features including a ridge 570D and a protruding locating feature 270B described herein. The second module 560 may be customized, such as with a graphical image, with added cushioning for fit, or otherwise.

Either or both of the modules 580, 560 may be customized in accordance with a customer request for a specified characteristic using secondary processing. Once customization procedures are complete, the inner surface 566C of the first flange 564C is fit against and secured to the peripheral side surface 28 of the sole structure 512 with the first flange 564C in the first recess 30A, and the inner surface 566D of the second flange 564D fit against and secured to the peripheral side surface 28 of the sole structure 512 in the second recess 30B. Securing the flanges 564C, 564D to the sole structure 512 includes first aligning and securing the ridges 570C, 570D with the slots 568A, 568B, and the second locating features 270F, 270B with the first locating features 68F, 68B. For example, the flanges 564C, 564D may be secured to the sole structure 512 in these positions by thermal processing. As assembled, the first flange 564C is separated from the second flange 564D by the non-recessed portions 569A, 569B of the peripheral side surface 28. Optionally, prior to or after the thermal processing to secure the flanges 564C, 564D to the sole structure 512, one or both of the upper components 514, 516C can be secured to the upper components 516A, 516B, such as by stitching, adhesive, or otherwise. FIG. 25 illustrates the overlap of the upper component 516A with the upper component 514, showing the medial edge 577 of upper component 514 disposed inward of upper component 516A. Upper component 516A also overlaps upper component 516C, with the medial edge 579 of upper component 516C shown disposed inward of upper component 516A. Similar overlap exists with the upper components 514 and 516B, and with the upper components 516C and 516B on the lateral side. In these overlapped regions, the upper components may be secured to one another to further secure the modules 560 and 580 to the module 550.

Figure 26:
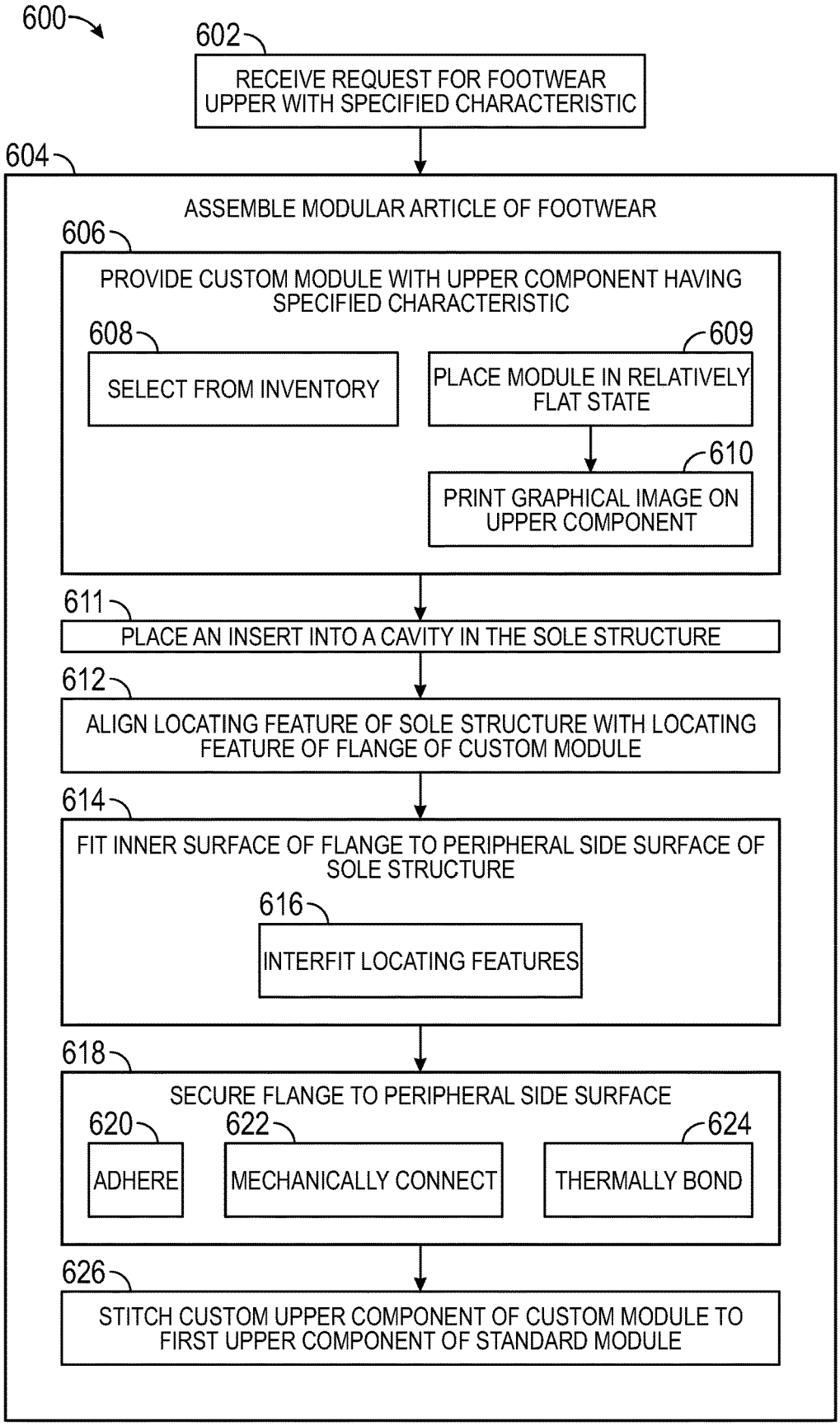
FIG. 26 is a flowchart illustrating a method of manufacturing customizable articles of footwear.

FIG. 26 shows a flowchart representing a method 600 of manufacturing a customized article of footwear. The method 600 is applicable to the articles of footwear 10, 110, 210, 310, 510 that include the sole structures 12, 12A, 12B, 112, 212, 512, and modules 50, 60, 150, 160, 260, 280, 380, 480, 550, 560, 580 described herein. Under the method 600, a footwear manufacturer or retailer will have on hand an inventory of various sets of modules in order to be ready to satisfy a number of different possible customer requests for customized uppers. By way of non-limiting example, within the scope of the disclosure, the specified characteristic requested may be one of an aesthetic characteristic, a performance characteristic, a dimensional characteristic, a material, a physical property, or a footwear style. Examples of an aesthetic characteristic include a graphical image, such as a number, a picture, a name, or other text, or simply a choice of color of the upper component or a portion thereof. Some modules in the inventory may have undergone processing steps such that the requested specified characteristic is already present at the time the request is received. For example, some aesthetic characteristics, including some images may be pre-printed or otherwise provided on an upper component included in a module that is kept at hand in inventory, ready for securement to other modules in assembling an article of footwear meeting the customer's request. Some modules having different performance characteristics may be kept at hand in inventory, ready for securement to other modules in assembling an article of footwear meeting the customer's request. The performance characteristics may be categorized by the retailer, for example, as supportive, lightweight, providing tactile feedback, etc. Examples of performance characteristics may include upper components categorized by the manufacturer as stiff, flexible, supportive, breathable, for training, for leisure etc., and may be related to specified characteristics which are more specific physical properties, such as a stiffness within a range of numerical stiffnesses, elasticity within a range of elasticities, etc.

The modules with specific performance characteristics may also have different materials and/or physical properties that satisfy requests for these characteristics. For example, a request may be for a textile upper, a leather upper, or an upper of a different material, and modules with these types of upper components can be kept in an inventory and selected to satisfy a customer's request. A request may be for an upper that has a medial side with a greater stiffness than a lateral side, in order to inhibit pronation. Modules with upper components of different stiffnesses, including stiffnesses that are different on the medial side or the lateral side can be kept in an inventory and selected to satisfy a customer's request. The request may be for a right foot article of footwear having an upper component with a greater stiffness in the heel region than a left foot article of footwear to support a weaker right ankle, for example. The request may be for upper components creating a custom-sized foot-receiving cavity in order to provide custom support for a customer's specific foot anomaly. This can be satisfied, for example, by providing a greater amount of foam padding in certain areas of the upper components. The amount of padding can also be varied to satisfy a request for a specific foot size. For example, a module with an upper component with less padding can be used to satisfy a half size larger foot size request, and a module with an upper component with more padding can be used for a half size smaller foot size request, both using the same sole structure. Modules with upper components having different amounts of padding can be kept in an inventory and selected to satisfy these or other customer requests. Examples of dimensional characteristics may include thickness of the upper, which may be determined by the amount of padding that can be added to satisfy a specified request. For example, the thickness of the upper can be selected to enable the same size sole structure to be used for orders within a half-size of one another. A module with a relatively thick upper can be used if the customer requests footwear of a first size, while a relatively thin upper can be used if the customer requests footwear of a second size larger than the first size, as the flange that interfaces with the sole structure will be identical with either module. This enables a smaller inventory of sole structures to be kept on hand by a seller and/or manufacturer. The dimensions of the upper can be tailored to satisfy a specified request in order to be optimal for a customer with a foot abnormality.

An upper component of a first footwear style, such as a high top style can be kept in an inventory and selected to satisfy a customer's request for a high top, while a module having an upper component with a second footwear style, such as a low-top, can be kept in an inventory and selected to satisfy a customer's request for a low top. Examples of materials may include leather, textiles, polymers, cottons, composites, etc., with different weaves, braids or knits. Examples of footwear styles may include high top, low top, mule, etc.

The footwear module 60 of FIGS. 4-5 is manufactured to the state shown in FIGS. 4-5, and is then placed in an inventory awaiting a customer request before final assembly in an article of footwear. More specifically, the flange 64 is secured to the upper component 14 by optionally, marking gauge points on the outer surface of the upper component 14, adding primer and cement or other adhesive on the surface areas of the upper component 14 and/or the flange 64 to be joined, attaching the flange 64 to the upper component 14, and then pressing the flange 64 and the upper component 14 to one another while the cement cures.

In another example, the footwear module 50 of FIGS. 2-3 is manufactured to the state shown in FIGS. 2-3 then placed in an inventory awaiting a customer request before subsequent final assembly in an article of footwear. For example, a strobel may first be cut and sewn, and then secured to the upper component 14 around a last. At this point, a temporary upper heel portion may be secured to the upper component 14 to occupy a position where upper component 16 will later be secured, in order to more properly shape the upper component 16 prior to securement to the sole structure 12. Gauge points are marked on the upper component 16, and primer and cement or other adhesive is applied on the surface areas of the upper and strobel to be joined to the sole structure 12. The upper component 16 and strobel are secured to the sole structure 12 and the assembly is allowed to cure. The last is then removed from the upper component 16, and the temporary heel is removed.

In another aspect of the method 600, the sole structure 12A and/or 12B of FIGS. 29-31 may be placed in an inventory, along with a selection of corresponding inserts 58A, 58B, 58C, 58D of various stiffnesses. The inserts are available to be placed into a cavity on the medial side and/or the lateral side of the sole structure 12A or 12B as described herein to modify the sole structure in correspondence with a specified stiffness or stability characteristic. For example, if a request for a stiffer (e.g., more firm, less easily compressible, etc.) heel region 22 at the medial side 32 is requested, inserts of greater stiffness than the material of the sole structure 12A or 12B can be placed in the cavity or cavities at the medial side 32, as described herein. If a request for relatively high lateral stability is requested (i.e., a request for a sole structure stiffer on the lateral side 36 than on the medial side 32), inserts of greater stiffness than the material of the sole structure 12A or 12B can be placed at least in the cavity or cavities at the lateral side 36.

Figure 27:
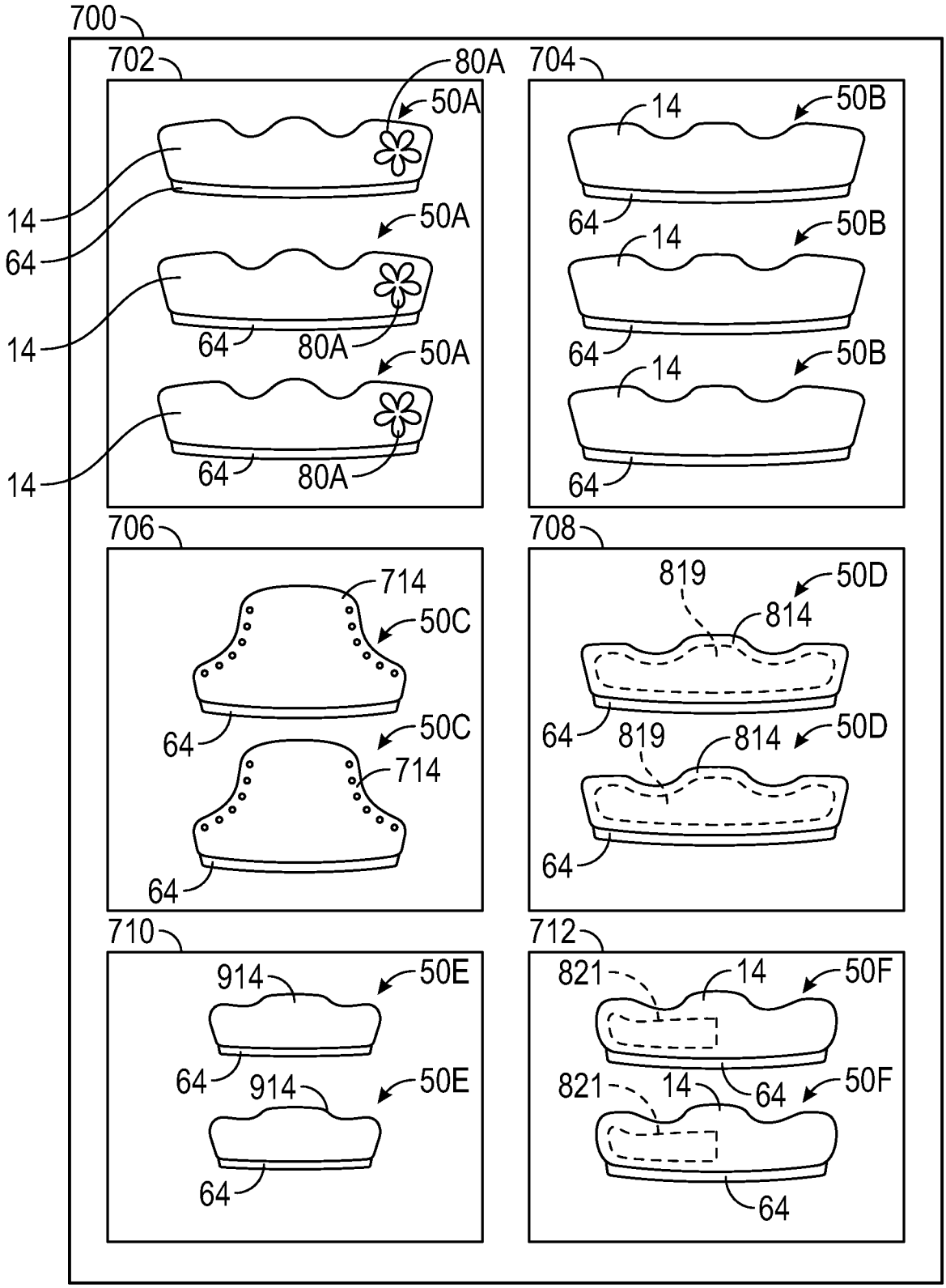
FIG. 27 is a schematic illustration of an inventory of various modules for use in manufacturing customizable modular articles of footwear according to the method of FIG. 26.

FIG. 27 shows an example inventory 700 of various modules that include upper components having different characteristics that may satisfy a customer's request for a specified characteristic, or that are sufficient to enable secondary processing that will provide the specified characteristic. For example, the inventory 700 includes a set 702 of modules 50A that include an upper component 14 secured to a flange 64, with the upper component 14 already having the graphical image 80A thereon. The inventory 700 also includes a set 704 of modules 50B that may be alike in every aspect as modules 50A except that the graphical image 80A is not on the upper component 14. The module 50B may not have a graphical image, allowing the module 50B to be used where a graphical image 80A is not requested, or if a different graphical image is requested than graphical image 80A provide on the modules 50A, it will be provided on the upper component 14 of the module 50B as secondary process, following the request. Still further, the modules 50B may have a different graphical image already provided on the upper component 14 when stored in the inventory.

The inventory 700 includes a set 706 of modules 50C that include an upper component 714 secured to a flange 64, with the upper component 714 being a high top style, while the upper components 14 of the sets 702, 704 are a low top style. The inventory 700 includes a set 708 of modules 50D that include an upper component 814 secured to a flange 64, with the upper component 814 having additional padding 819 to provide a different dimensional characteristic as discussed herein. The inventory 700 includes a set 710 of modules 50E that include an upper component 714 secured to a flange 64, with the upper component 714 being a smaller size than the upper components 14 of the modules 50A, 50B. The inventory 700 includes a set 712 of modules 50F that include an upper component 14 secured to a flange 64, with a stiffening plate 721 embedded in a medial side of the upper component 14, providing a higher stiffness on the medial side of the upper component 14 than on the lateral side.

The sets 702-712 of modules shown and described in the inventory 400 are representative examples of different modules. However, the inventory 700 may include modules with other specified characteristics that will satisfy various customer requests, or that are suitable for secondary processing to satisfy a specified request. For example, the inventory 700 may also include the sole structures 12A, 12B and inserts 58A-58D of FIGS. 29-31.

Referring to FIG. 26, the method 600 begins when a request for an upper with a specified characteristic is received in block 602. Within the scope of the method 600, the request may be received in a number of different ways. Additionally, the request may be received by a retailer or by a manufacturer. The request may be an electronic order placed on a manufacturer's or retailer's website, mobile or online application (i.e., "app"), social media page, or by email. Alternatively, the request may be received in block 602 by telephone, by mail, or in person.

Once the request is received in block 602, the method 600 proceeds to block 604, assembling a modular article of footwear in accordance with the request by securing a module to a sole structure. The sole structure has a foot-facing surface 24, a ground-engaging surface 26, and a peripheral side surface 28 extending between the foot-facing surface 24 and the ground-engaging surface 26, as described with respect the sole structures 12, 112, 212, and 512 herein. The peripheral side surface 28 has at least one recess 30 as described herein. In some cases, the sole structure may be a module separate from any upper components, as is the sole structure 212 of FIG. 14. In other embodiments, the sole structure is included in a module that has an upper component secured to the sole structure, as shown and described with respect to modules 50, 150 and 450.

Assembling the modular article of footwear in block 604 includes providing a custom module with an upper component having the specified characteristic in block 606. In block 606, the custom module with an upper component having the specified characteristic may be selected from an inventory of modules in block 608, wherein the inventory includes at least a first set of modules and a second set of modules, and wherein each of the modules of the first set has an upper component that has the specified characteristic. For example, each of the modules of the second set may have an upper component without the specified characteristic. Each of the modules of the second set may have an upper component with a characteristic different than the specified characteristic. In either case, selecting the module from the first set is identified as satisfying the customer's request.

For example, if the specified characteristic is the graphical image 80A shown on the modules 50A, or the high top type module 50C, or a dimensional characteristic satisfied by the added padding 519 of modules 50D, or the size of the modules 50E, or a stiffness characteristic provided by the modules 50F, one of these modules pre-manufactured to possess the specified characteristic is selected in block 608 as a module of the first set with respect to the specific customization.

Alternatively or in addition, a module selected from the inventory 400 may need to be customized with secondary processes in order to possess the specified characteristic. For example, the specified characteristic may be a graphical image different from graphical image 80A and different from other pre-processed graphical images on modules on hand in inventory 700. In that case, block 606 may include block 610, printing of the graphical image on a surface of the upper component prior to securing the inner surface of the flange 64 to the peripheral side surface 28 of the sole structure. In an embodiment, the printing is ink-jet printing, and the method 600 further comprises block 609, prior to the printing the graphical image on the surface of the upper component, placing the module in a first state in which a predetermined region of a surface of the upper component has a maximum variance in elevation of less than or equal to 10 millimeters in the first state, as described with respect to FIGS. 7-8. FIG. 18 shows another example of block 609 in which the surface of module 380 to be printed on is placed in a relatively flat state and secured with a jig 365 for customization. The printing of the graphical image on the surface of the upper component is with the module in the first state. Blocks 609 and 610 are optional, and are suitable for some example embodiments. In other embodiments, the graphical image may be provided by ink-jet printing, but with a printer that can optimally print without a maximum elevation of 10 mm or less being required. In still other embodiments, the graphical image may be provided by processes other than ink-jet printing, such as but not limited to three-dimensional printing, painting, stamping, heat transfer, etc., in which case block 606 would include these additional processes.

In an example embodiment in which the sole structure to be assembled in the customized article of footwear has one or more first locating features, and the flange 64 included on the custom module to be secured to the sole structure has one or more second locating features that interfit with the first locating features, the method 600 may include block 612, aligning the first locating feature of the sole structure (e.g., locating feature 68) with the second locating feature of the flange 64 (e.g., locating feature 70). For example, the aligning may occur with any of modules 60, 160, 260, 280, 380, 480, 550, 560, 580 as described herein. In an example embodiment in which the at least one first locating feature includes a slot 168, 268, 568A, or 568B extending along the peripheral side surface of the sole structure to, and the at least one second locating feature includes a ridge 170, 270, 370, 470, 570C, 570D protruding at the inner surface of the flange 64, the method may further comprise aligning the ridge with the slot prior to the interfitting the slot with the ridge. In an embodiment, block 602 may further include receiving a request for a sole structure with a specified stiffness or stability characteristic, in which case, prior to block 612, the method 600 may include block 611, placing an insert in a cavity in the peripheral side surface of the sole structure, as shown and described with respect to FIGS. 28-31, wherein the insert (e.g., insert 58A, 58B, 58C, 58D) has a compressive stiffness different than the sole structure (e.g., 12A or 12B), and the sole structure with the insert therein provides the specified stiffness or stability characteristic. In another embodiment, the sole structure does not have any inserts inserted into a cavity in the sole structure, or does not have any cavities in the sole structure to receive an insert, and the method 600 instead proceeds from block 606 directly to block 612.

The method 600 may include block 614, fitting an inner surface 66 of the flange 64 against the peripheral side surface 28 of the sole structure with the flange in the at least one recess 30 and with the upper component 14 partially defining a foot-receiving cavity 52 over the foot-facing surface 24 (or with similar upper components as those shown in FIGS. 18-25). For example, with respect to sole structure 512, flange 564C is in first recess 30A and flange 564D is in second recess 30B. Within the scope of the disclosure, fitting the inner surface of the flange 64 to the peripheral side surface 28 of the sole structure may include block 616, interfitting the locating features of the flange 64 to the sole structure 12, 112, or 212, or similar locating features of flanges 364, 464, 564C, or 564D to the respective sole structures 212, 512, as once the locating features are aligned, they are configured to interfit.

Next, in block 618, the flange 64 is secured to the peripheral side surface 28 of sole structure 12, or the flanges 364, 464, 564C, or 564D are secured to the respective sole structures 212, 512. Dependent upon the structure and materials of the flange and the sole structure, block 618 can be carried out in different ways. For example, in an embodiment, block 618 may include block 620, adhering the flange 64 to the peripheral side surface 28. The flange 64 can be adhered to the sole structure 112 with adhesive 194 as described with respect to FIG. 13. In another embodiment, the flange 64 and the sole structure are configured to mechanically connect to one another, such as described with respect to locating features 68, 70 that may have an interference fit, or slot 168 and ridge 170, in which case block 618 includes block 622, mechanically connecting the flange 64 to the peripheral side surface 28. In the same or a different embodiment, securing the inner surface of the flange 64 to the peripheral side surface 28 of the sole structure in block 618 can include block 624, thermally bonding the inner surface of the flange to the peripheral side surface of the sole structure, as described herein.

In some embodiments, the method 600 may include block 626, stitching the upper component to the additional upper component after the securing the flange of the second module to the peripheral side surface of the sole structure. For example, stitching 72 is provided as shown and described with respect to each of the articles of footwear 10, 110, 210, 310, and 510.

The method 600 enables customization requests specific to one article of footwear of a pair of footwear, such as a right shoe or a left shoe, so that the right shoe and the left shoe will be different after customization of one or both under the method 600. For example, in an embodiment, the method 600 as described is first performed for an article of footwear that is a first article of footwear of a pair of footwear that includes the first article of footwear and a second article of footwear. The specified characteristic is a first specified characteristic. One of the first article of footwear and the second article of footwear has a right foot orientation and the other of the first article of footwear and the second article of footwear has a left foot orientation. The method 600 is then performed again for the second article of footwear, and the request received in block 602 is for an upper with a second specified characteristic different than the first specified characteristic.

Accordingly, the second article of footwear is assembled under the method 600 in accordance with the request for the second article of footwear by securing an inner surface of an additional flange of an additional module to a sole structure of the second article of footwear, such as additional module 280. Similar to the first article of footwear, the sole structure of the second article of footwear has a foot-facing surface, a ground-engaging surface, and a peripheral side surface extending between the foot-facing surface and the ground-engaging surface. The peripheral side surface of the second article of footwear has at least one recess. The additional module has an additional upper component secured to the additional flange of the additional module, and the additional upper component has the second specified characteristic.

In another embodiment in which the customization request for the left article of footwear is different than for the right article of footwear, assembling the modular article of footwear in accordance with the request may further include securing a second module to the sole structure, such as a second module 60 or 160. The second module includes an additional upper component 14, and an additional flange 64 secured to the additional upper component and projecting therefrom. Securing the second module to the sole structure may comprise fitting an inner surface of the additional flange against the peripheral side surface of the sole structure with the additional flange in the at least one recess and with the additional upper component further defining the foot-receiving cavity.

The following Clauses provide example configurations of a sole structure for an article of footwear disclosed herein.

Clause 1: A modular article of footwear comprising: a sole structure having a foot-facing surface, a ground-engaging surface, and a peripheral side surface extending between the foot-facing surface and the ground-engaging surface; wherein the peripheral side surface has at least one recess; an upper component; a flange secured to the upper component and projecting therefrom; and wherein an inner surface of the flange fits against and is securable to the peripheral side surface of the sole structure with the flange in the at least one recess, and the upper component at least partially defining a foot-receiving cavity over the foot-facing surface.

Clause 2: The modular article of footwear of Clause 1, wherein: the sole structure and the upper component each include a forefoot region, a midfoot region, and a heel region; the at least one recess is a single recess extending around the peripheral side surface throughout the forefoot region, the midfoot region, and the heel region of the sole structure; and the flange is a single flange extending around the forefoot region, the midfoot region, and the heel region of the upper component.

Clause 3: The modular article of footwear of Clause 2, wherein: the upper component has a split heel region; and the flange has a first end at a medial side of the split heel region, and a second end at a lateral side of the split heel region.

Clause 4: The modular article of footwear of Clause 1, wherein: the sole structure is included in a first module having an additional upper component secured to the sole structure and partially defining the foot-receiving cavity over the foot-facing surface; the additional upper component is spaced apart from the at least one recess; and the upper component and the flange are a second module.

Clause 5: The modular article of footwear of Clause 1, wherein the upper component is a first upper component and the flange is a first flange, the modular article of footwear further comprising; a second upper component; a second flange secured to the second upper component and projecting therefrom; and wherein an inner surface of the second flange and the peripheral side surface of the sole structure are configured to fit against one another with the second flange in the at least one recess, the second upper component further defining the foot-receiving cavity, and the second flange secured to the peripheral side surface.

Clause 6: The modular article of footwear of Clause 5, wherein: the at least one recess includes a first recess and a second recess separated from the first recess by a non-recessed portion of the peripheral side surface of the sole structure; the inner surface of the first flange fits against and is securable to the peripheral side surface of the sole structure with the first flange in the first recess; the inner surface of the second flange fits against and is securable to the peripheral side surface of the sole structure with the second flange in the second recess; and the first flange is separated from the second flange by the non-recessed portion of the peripheral side surface.

Clause 7: The modular article of footwear of Clause 5, wherein, when the second flange is secured to the peripheral side surface of the sole structure in the recess, the second upper component is adjacent to the first upper component; and the second upper component is secured to the first upper component.

Clause 8: The modular article of footwear of any of Clauses 1-7, wherein: the peripheral side surface of the sole structure has at least one first locating feature in the at least one recess; the flange has at least one second locating feature at the inner surface; and the at least one first locating feature interfits with the at least one second locating feature.

Clause 9: The modular article of footwear of Clause 8, wherein the at least one first locating feature is one of a protrusion of, or a recess in, the peripheral side surface of the sole structure.

Clause 10: The modular article of footwear of any of Clauses 8-9, wherein: the at least one first locating feature is one of a ridge and a slot; the at least one second locating feature is the other of the ridge and the slot; and the ridge fits within the slot.

Clause 11: The modular article of footwear of Clause 10, wherein: the at least one first locating feature is the slot; the slot extends in the peripheral side surface along a rear periphery of the sole structure from a medial side of the sole structure to a lateral side of the sole structure; the second locating feature is the ridge; and the ridge protrudes at the inner surface of the flange.

Clause 12: The modular article of footwear of any of Clauses 1-11, wherein: the sole structure and the flange mechanically secure to one another.

Clause 13: The modular article of footwear of any of Clauses 1-12, wherein the sole structure has one of a male connector and a female connector, and the flange has the other of the male connector and the female connector.

Clause 14: The modular article of footwear of any of Clauses 1-13, wherein: the peripheral side surface of the sole structure has a curvature at the at least one recess; the upper component and the flange secured thereto are sufficiently flexible to adopt a first state when the flange is disjoined from the sole structure, and a second state when the flange is secured to the sole structure in the at least one recess; a predetermined region of a surface of the upper component has a maximum variance in elevation of less than or equal to 10 millimeters in the first state; and the inner surface of the flange has the curvature of the peripheral side surface in the second state.

Clause 15: The modular article of footwear of Clause 14, wherein: the predetermined region of the surface of the upper component has a graphical image thereon; and the graphical image is comprised of ink.

Clause 16: The modular article of footwear of any of Clauses 1-15, wherein: the upper component is a first material; and the flange is a second material.

Clause 17: The modular article of footwear of Clause 16, wherein the peripheral side surface of the sole structure is the second material.

Clause 18: The modular article of footwear of Clause 16, further comprising: an adhesive disposed on either or both of the inner surface of the flange and the peripheral side surface of the sole structure.

Clause 19: The modular article of footwear of any of Clauses 1-18, wherein an outer surface of the flange is flush with an adjacent portion of the peripheral side surface when the inner surface of the flange and the peripheral side surface of the sole structure are fit against and secured to one another with the flange in the at least one recess.

Clause 20: The modular article of footwear of any of Clauses 1-19, wherein the sole structure has a cavity at the peripheral side surface, and further comprising: an insert shaped and sized to fit within the cavity; and wherein the insert has a different compressive stiffness than the sole structure.

Clause 21: A method of manufacturing a customized article of footwear comprising: receiving a request for an upper with a specified characteristic; assembling a modular article of footwear in accordance with the request by securing a module to a sole structure; wherein: the sole structure has a foot-facing surface, a ground-engaging surface, and a peripheral side surface extending between the foot-facing surface and the ground-engaging surface, the peripheral side surface has at least one recess; the module includes an upper component having the specified characteristic, and a flange secured to the upper component and projecting therefrom; and said securing the module to the sole structure comprises: fitting an inner surface of the flange against the peripheral side surface of the sole structure with the flange in the at least one recess and with the upper component partially defining a foot-receiving cavity over the foot-facing surface; and securing the inner surface of the flange to the peripheral side surface of the sole structure.

Clause 22: The method of Clause 21, wherein the peripheral side surface has at least one first locating feature in the at least one recess, the flange has at least one second locating feature at the inner surface; and said fitting the inner surface of the flange to the peripheral side surface of the sole structure includes interfitting the at least one first locating feature with the at least one second locating feature.

Clause 23: The method of Clause 22, wherein: the at least one first locating feature includes a slot extending along the peripheral side surface from a medial side of the sole structure to a lateral side of the sole structure; the at least one second locating feature includes a ridge protruding at the inner surface of the flange; and the method further comprising aligning the ridge with the slot prior to said interfitting the slot with the ridge.

Clause 24: The method of any of Clauses 21-23, wherein the upper component has a split heel region, the flange has a first end at a medial side of the split heel region and a second end at a lateral side of the split heel region, and the specified characteristic is a graphical image; the method further comprising: printing the graphical image on a surface of the upper component prior to said securing the inner surface of the flange to the peripheral side surface of the sole structure; and after said printing and prior to said fitting the inner surface of the flange against the peripheral side surface and said securing the inner surface of the flange to the peripheral side surface, securing the lateral side of the split heel region to the medial side of the split heel region.

Clause 25: The method of any of Clauses 21-24, further comprising: selecting the module from an inventory of modules; and wherein the inventory includes at least a first set of modules and a second set of modules, and each of the modules of the first set has an upper component that has the specified characteristic.

Clause 26: The method of Clause 25, wherein each of the modules of the second set has an upper component without the specified characteristic.

Clause 27: The method of Clause 25, wherein each of the modules of the second set has an upper component with a characteristic different than the specified characteristic.

Clause 28: The method of any of Clauses 21-27, wherein the specified characteristic is one of an aesthetic characteristic, a performance characteristic, a dimensional characteristic, a material, a physical property, or a footwear style.

Clause 29: The method of any of Clauses 21-28, wherein the specified characteristic is a graphical image, and the method further comprising: printing the graphical image on a surface of the upper component prior to said securing the inner surface of the flange to the peripheral side surface of the sole structure.

Clause 30: The method of Clause 29, wherein said printing is ink-jet printing, and the method further comprising: prior to said printing the graphical image on the surface of the upper component, placing the module in a first state; wherein a predetermined region of a surface of the upper component has a maximum variance in elevation of less than or equal to 10 millimeters in the first state; and wherein said printing the graphical image on the surface of the upper component is with the module in the first state.

Clause 31: The method of any of Clauses 21-30, wherein said securing the inner surface of the flange to the peripheral side surface of the sole structure includes adhering the inner surface of the flange to the peripheral side surface of the sole structure.

Clause 32: The method of any of Clauses 21-30, wherein said securing the inner surface of the flange to the peripheral side surface of the sole structure includes thermally bonding the inner surface of the flange to the peripheral side surface of the sole structure.

Clause 33: The method of any of Clauses 21-32, wherein: the article of footwear is a first article of footwear of a pair of footwear that includes the first article of footwear and a second article of footwear; the specified characteristic is a first specified characteristic; one of the first article of footwear and the second article of footwear has a right foot orientation and the other of the first article of footwear and the second article of footwear has a left foot orientation; the method further comprising: receiving a request for the second article of footwear having a second upper with a second specified characteristic different than the first specified characteristic; assembling the second article of footwear in accordance with the request for the second article of footwear by securing an inner surface of an additional flange of an additional module to a sole structure of the second article of footwear; wherein: the sole structure of the second article of footwear has a foot-facing surface, a ground-engaging surface, and a peripheral side surface extending between the foot-facing surface and the ground-engaging surface; the peripheral side surface of the second article of footwear has at least one recess; and the additional module has an additional upper component secured to the additional flange of the additional module, and the additional upper component has the second specified characteristic.

Clause 34: The method of any of Clauses 21-33, wherein the sole structure is included in a first module having an additional upper component secured to the sole structure and partially defining the foot-receiving cavity over the foot-facing surface, the additional upper component is spaced apart from the at least one recess, and the upper component and the flange are a second module, and the method further comprising: stitching the upper component to the additional upper component after said securing the flange to the peripheral side surface of the sole structure.

Clause 35: The method of Clause 21, wherein: the upper component is a first upper component; the flange is a first flange; the specified characteristic is a first specified characteristic, and the request for the upper further includes a second specified characteristic; said assembling the modular article of footwear in accordance with the request further includes securing a second module to the sole structure; wherein the second module includes an additional upper component, and an additional flange secured to the additional upper component and projecting therefrom; and said securing the second module to the sole structure comprises fitting an inner surface of the additional flange against the peripheral side surface of the sole structure with the additional flange in the at least one recess and with the additional upper component further defining the foot-receiving cavity.

Clause 36: The method of Clause 35, wherein: the at least one recess includes a first recess and a second recess separated from the first recess by a non-recessed portion of the peripheral side surface of the sole structure; said fitting the inner surface of the flange against the peripheral side surface of the sole structure is with the flange in the first recess; and said fitting an inner surface of the additional flange against the peripheral side surface of the sole structure is with the additional flange in the second recess and with the flange separated from the additional flange by the non-recessed portion of the peripheral side surface.

Clause 37: The method of any of Clauses 21-36, further comprising: receiving a request for a sole structure with a specified stiffness or stability characteristic; placing an insert into a cavity in the sole structure; and wherein the insert has a compressive stiffness different than the sole structure, and the sole structure with the insert therein provides the specified stiffness or stability characteristic.

Clause 38: An article of footwear comprising: an upper component; a flange secured to the upper component and projecting therefrom; and wherein the flange is a polymer foam.

Clause 39: The article of footwear of Clause 38, wherein: the upper component includes a forefoot region, a midfoot region, and a heel region; and the flange extends along the forefoot region, the midfoot region, and the heel region of the upper component.

Clause 40: The article of footwear of Clause 38, wherein: the upper component has a split heel region; and the flange has a first end at a medial side of the split heel region and a second end at a lateral side of the split heel region.

Clause 41: The article of footwear of Clause 38, wherein the upper component comprises only a heel region.

Clause 42: The article of footwear of Clause 38, wherein the upper component comprises only a forefoot region.

Clause 43: The article of footwear of Clause 38, wherein the upper component comprises only a midfoot region.

Clause 44: The article of footwear of Clause 38, wherein the upper component comprises not more than two selected from among a forefoot region, a midfoot region, and a heel region.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

The invention claimed is:

1. A modular article of footwear comprising:

a first module including:

a sole structure having a foot-facing surface, a ground-engaging surface, and a peripheral side surface extending between the foot-facing surface and the ground-engaging surface and from a medial side of the sole structure to a lateral side of the sole structure;

wherein the peripheral side surface has at least one recess; and a second module disjoined from the first module in a first state and joined to the first module in a second state, the second module including:

an upper component; and a flange secured to the upper component and projecting therefrom, the flange having a medial end and a lateral end;

wherein the flange is flatter when the second module is in the first state with the medial end and the lateral end further apart from one another than when the second module is in the second state; and wherein an inner surface of the flange fits against and is permanently secured to the peripheral side surface of the sole structure with the flange in the at least one recess and wherein an outer surface of the flange directly opposite the secured inner surface is exposed and faces away from the peripheral side surface of the sole structure when the second module is in the second state with the medial end at the medial side of the sole structure and the lateral end at the lateral side of the sole structure, and the upper component serving as at least a portion of a footwear upper at least partially defining a foot-receiving cavity over the foot-facing surface; and a stitching directly connecting the first module to the second module.

2. The modular article of footwear of claim 1, wherein:

the first module has an additional upper component secured to the sole structure serving as an additional portion of the footwear upper and partially defining the foot-receiving cavity over the foot-facing surface; and the additional upper component is spaced apart from the at least one recess.

3. The modular article of footwear of claim 2, wherein the upper component of the second module and the additional upper component of the first module overlap above a mid-foot region of the sole structure at a medial side of the sole structure and at a lateral side sole structure in the second state.

4. The modular article of footwear of claim 3, wherein the upper component of the second module extends around a heel region of the modular article of footwear from the medial side to the lateral side in the second state.

5. The modular article of footwear of claim 1, wherein:

the peripheral side surface of the sole structure has at least one first locating feature in the at least one recess;

the flange has at least one second locating feature at the inner surface; and the at least one first locating feature interfits with the at least one second locating feature.

6. The modular article of footwear of claim 5, wherein the at least one first locating feature is one of a protrusion of, or a recess in, the peripheral side surface of the sole structure.

7. The modular article of footwear of claim 5, wherein:

the at least one first locating feature is one of a ridge and a slot;

the at least one second locating feature is the other of the ridge and the slot; and the ridge fits within the slot.

8. The modular article of footwear of claim 1, wherein:

the sole structure and the flange mechanically secure to one another.

9. The modular article of footwear of claim 1, wherein the sole structure has one of a male connector and a female connector, and the flange has the other of the male connector and the female connector.

10. The modular article of footwear of claim 1, wherein:

the peripheral side surface of the sole structure has a curvature at the at least one recess;

a predetermined region of a surface of the upper component has a maximum variance in elevation of less than or equal to 10 millimeters in the first state; and the inner surface of the flange has the curvature of the peripheral side surface in the second state.

11. The modular article of footwear of claim 10, wherein:

the predetermined region of the surface of the upper component has a graphical image thereon; and the graphical image is comprised of ink.

12. The modular article of footwear of claim 1, wherein:

the upper component is a first material; and the flange is a second material.

13. The modular article of footwear of claim 12, wherein the peripheral side surface of the sole structure is the second material.

14. The modular article of footwear of claim 1, wherein an outer surface of the flange is flush with an adjacent portion of the peripheral side surface when the inner surface of the flange and the peripheral side surface of the sole structure are fit against and secured to one another with the flange in the at least one recess.

15. A modular article of footwear comprising:

a first module including:

a sole structure having a foot-facing surface, a ground-engaging surface, and a peripheral side surface extending between the foot-facing surface and the ground- engaging surface and from a medial side of the sole structure to a lateral side of the sole structure;

wherein the peripheral side surface has at least one recess; and a second module disjoined from the first module in a first state and joined to the first module in a second state, the second module including:

an upper component; and a flange secured to the upper component and projecting therefrom, the flange having a medial end and a lateral end;

wherein the flange is flatter when the second module is in the first state with the medial end and the lateral end further apart from one another than when the second module is in the second state;

wherein an inner surface of the flange fits against and is permanently secured to the peripheral side surface of the sole structure with the flange in the at least one recess and wherein an outer surface of the flange directly opposite the secured inner surface is exposed and faces away from the peripheral side surface of the sole structure when the second module is in the second state with the medial end at the medial side of the sole structure and the lateral end at the lateral side of the sole structure, and the upper component serving as at least a portion of a footwear upper at least partially defining a foot-receiving cavity over the foot-facing surface; and an adhesive disposed on either or both of the inner surface of the flange and the peripheral side surface of the sole structure.

16. A modular article of footwear comprising:

a first module including:

a sole structure having a foot-facing surface, a ground-engaging surface, and a peripheral side surface extending between the foot-facing surface and the ground-engaging surface; wherein the peripheral side surface has at least one recess; and an upper component secured to the sole structure and partially defining a foot- receiving cavity over the foot-facing surface;

a second module including:

an upper component; and a flange secured to the upper component and projecting therefrom;

wherein an inner surface of the flange fits against and is permanently secured to the peripheral side surface of the sole structure with the flange in the at least one recess and wherein an outer surface of the flange directly opposite the secured inner surface is exposed and faces away from the peripheral side surface of the sole structure, with the upper component of the second module extending around the sole structure of the first module from a medial side of the sole structure to a lateral side of the sole structure and further defining the foot-receiving cavity over the foot-facing surface of the sole structure of the first module; and a thermal bond connecting the flange to the sole structure.

17. The modular article of footwear of claim 16, wherein the flange of the second module extends around a rear of the sole structure of the first module and has a medial end at the medial side of the sole structure and a lateral end at the lateral side of the sole structure.

18. The modular article of footwear of claim 16, wherein the upper component of the first module defines a forefoot region and a midfoot region of the foot-receiving cavity, and the upper component of the second module defines a heel region of the foot-receiving cavity.

* * * * *